US011753907B2

(12) United States Patent
Parkin et al.

(10) Patent No.: US 11,753,907 B2
(45) Date of Patent: Sep. 12, 2023

(54) PRESSURE ADJUSTER FOR A DOWNHOLE TOOL

(71) Applicant: Schlumberger Technology Corporation, Sugar Land, TX (US)

(72) Inventors: Edward George Parkin, Whitminster (GB); Julien Steimetz, Bristol (GB); Cecily Millwater, Hampshire (GB); Michael Pearce, Cheltenham (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 136 days.

(21) Appl. No.: 17/604,469

(22) PCT Filed: Apr. 30, 2020

(86) PCT No.: PCT/US2020/030634

§ 371 (c)(1),
(2) Date: Oct. 18, 2021

(87) PCT Pub. No.: WO2020/226989

PCT Pub. Date: Nov. 12, 2020

(65) Prior Publication Data

US 2022/0213763 A1 Jul. 7, 2022

Related U.S. Application Data

(60) Provisional application No. 62/842,836, filed on May 3, 2019.

(51) Int. Cl.

| | |
|---|---|
| ***E21B 4/00*** | (2006.01) |
| ***E21B 41/00*** | (2006.01) |
| ***E21B 34/08*** | (2006.01) |
| ***E21B 34/06*** | (2006.01) |

(52) U.S. Cl.

CPC ..... *E21B 41/0085* (2013.01); *E21B 34/06* (2013.01); *E21B 34/08* (2013.01); *E21B 2200/02* (2020.05)

(58) Field of Classification Search

CPC .. E21B 41/0085; E21B 34/08; E21B 2200/02; E21B 34/06

See application file for complete search history.

(56) References Cited

U.S. PATENT DOCUMENTS

| | | | | |
|---|---|---|---|---|
| 2,663,265 A * | 12/1953 | Garrett | E21B 43/123 137/155 |
| 4,532,614 A | 7/1985 | Peppers | |
| 5,959,380 A * | 9/1999 | Gillett | E21B 41/0085 310/90 |
| 7,430,153 B2 | 9/2008 | Fraser et al. | |

(Continued)

OTHER PUBLICATIONS

International Search Report and Written Opinion in International Patent Application No. PCT/US2020/030634, dated Aug. 12, 2020, 14 pages.

*Primary Examiner* — Brad Harcourt

(57) ABSTRACT

A downhole tool includes a housing and a housing chamber. The housing chamber is separated from a fluid chamber by a seal. The seal maintains a pressure differential between the housing chamber and the fluid chamber. A pressure adjuster between the housing chamber and the fluid chamber maintains the pressure differential below a maximum pressure differential.

18 Claims, 15 Drawing Sheets

(56) References Cited

U.S. PATENT DOCUMENTS

| | | | | |
|---|---|---|---|---|
| 9,383,029 | B2 * | 7/2016 | Scott | E21B 34/101 |
| 2009/0173499 | A1 * | 7/2009 | Gaudette | E21B 33/127 166/188 |
| 2009/0293606 | A1 | 12/2009 | Irani et al. | |
| 2011/0073295 | A1 | 3/2011 | Steele et al. | |
| 2013/0153044 | A1 | 6/2013 | Woodford | |
| 2020/0256161 | A1 * | 8/2020 | Vick, Jr. | E21B 34/06 |
| 2021/0131204 | A1 * | 5/2021 | Marshall | E21B 41/0085 |

* cited by examiner

PRESSURE ADJUSTER FOR A DOWNHOLE TOOL

CROSS-REFERENCE TO RELATED APPLICATIONS

This application claims the benefit of U.S. Non-Provisional application No. 62/842,836 entitled "Pressure Adjuster for a Downhole Tool," filed May 3, 2019, the disclosure of which is incorporated herein by reference.

BACKGROUND OF THE DISCLOSURE

Wellbores may be drilled into a surface location or seabed for a variety of exploratory or extraction purposes. For example, a wellbore may be drilled to access fluids, such as liquid and gaseous hydrocarbons, stored in subterranean formations and to extract the fluids from the formations. Wellbores used to produce or extract fluids may be lined with casing around the walls of the wellbore. A variety of drilling methods may be utilized depending partly on the characteristics of the formation through which the wellbore is drilled.

The wellbores may be drilled by a drilling system that drills through earthen material downward from the surface. Some wellbores are drilled vertically downward, and some wellbores have one or more curves in the wellbore to follow desirable geological formations, avoid problematic geological formations, or a combination of the two.

SUMMARY

In some embodiments, a downhole tool includes a housing with a housing chamber inside the housing. A fluid chamber is located outside the housing. A seal separates the housing chamber from the fluid chamber, the seal at least partially maintaining a pressure differential between the housing chamber and the fluid chamber. A pressure adjuster between the housing chamber and the fluid chamber maintains the pressure differential below a maximum pressure differential.

In other embodiments, a downhole tool includes a housing with a housing chamber inside the housing. A partition connected to the housing separates a fluid chamber outside the housing from the housing chamber. The partition prevents the passage of particulates between the housing chamber and a fluid chamber. A pressure adjuster between the housing chamber and the fluid chamber maintains the pressure differential below a maximum pressure differential.

In yet other embodiments, a downhole tool includes a housing with a first end and a second end. A movable member is connected to the housing at the housing first end with a bearing. The bearing has a gap of less than 500 μm between the bearing and the movable member. The movable member is rotatable relative to the housing. The movable member includes a central support. A bearing surface inside the housing at the second end supports the central support.

This summary is provided to introduce a selection of concepts that are further described below in the detailed description. This summary is not intended to identify key or essential features of the claimed subject matter, nor is it intended to be used as an aid in limiting the scope of the claimed subject matter.

Additional features and advantages of embodiments of the disclosure will be set forth in the description which follows, and in part will be obvious from the description, or may be learned by the practice of such embodiments. The features and advantages of such embodiments may be realized and obtained by means of the instruments and combinations particularly pointed out in the appended claims. These and other features will become more fully apparent from the following description and appended claims, or may be learned by the practice of such embodiments as set forth hereinafter.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which:

FIG. 2-1 is a cross-sectional view of a pressure adjuster on a downhole tool, according to at least one embodiment of the present disclosure;

FIG. 2-2 is cross-sectional view of another pressure adjuster on a downhole tool, according to at least one embodiment of the present disclosure;

FIG. 3-1 is a cross-sectional view of yet another pressure adjuster on a downhole tool, according to at least one embodiment of the present disclosure;

FIG. 3-2 is a cross-sectional view of still another pressure adjuster on a downhole tool, according to at least one embodiment of the present disclosure;

FIG. 8-1 is a cross-sectional view of still another pressure adjuster on a downhole tool, according to at least one embodiment of the present disclosure;

FIG. 8-2 is a cross-sectional view of yet another pressure adjuster on a downhole tool, according to at least one embodiment of the present disclosure;

DETAILED DESCRIPTION

Figure 1:
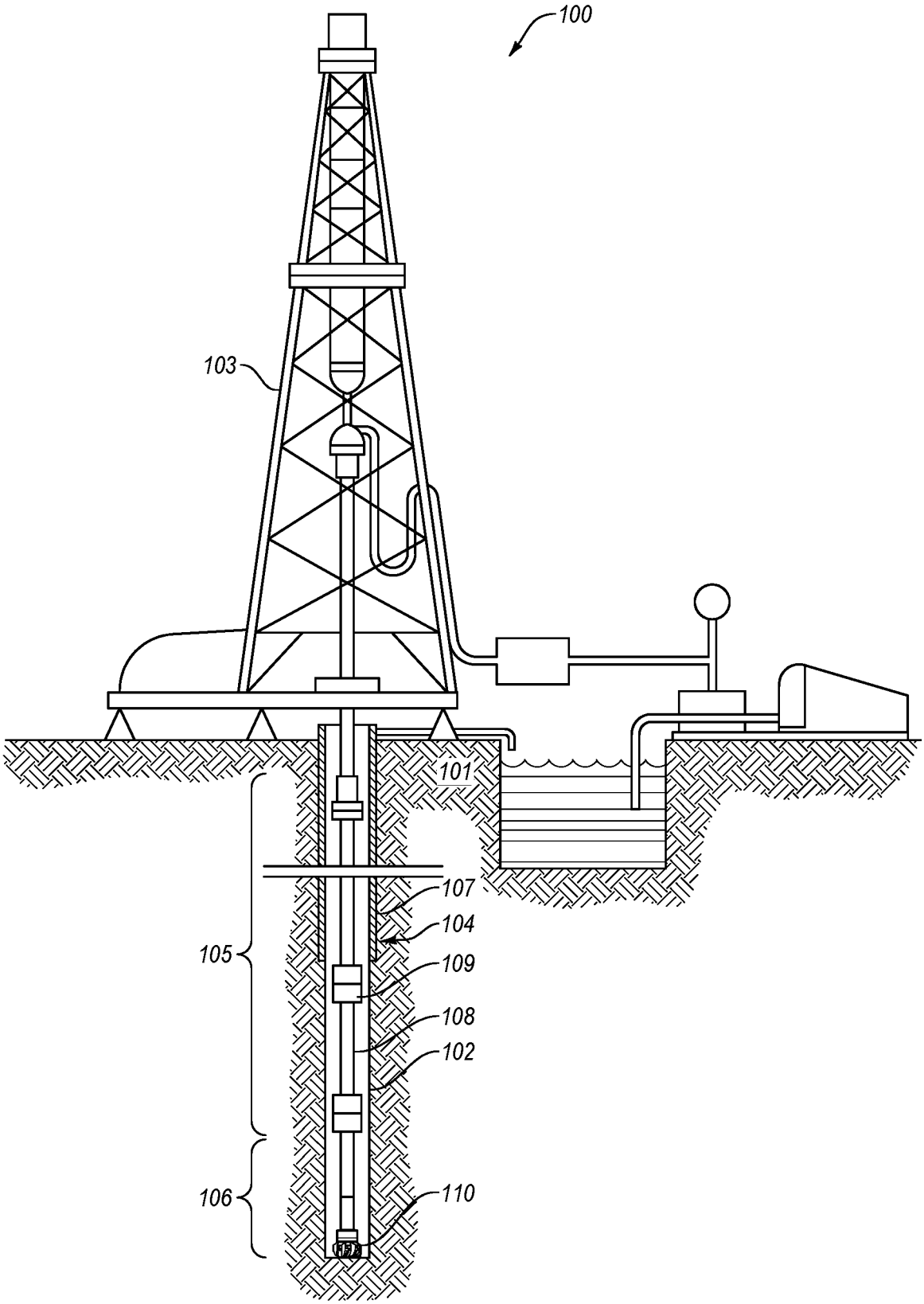
FIG. 1 is a representation of a drilling system, according to at least one embodiment of the present disclosure.

This disclosure generally relates to devices, systems, and methods for pressure adjustment between a movable member and a fluid chamber. FIG. 1 shows one example of a drilling system 100 for drilling an earth formation 101 to form a wellbore 102. The drilling system 100 includes a drill rig 103 used to turn a drilling tool assembly 104 which extends downward into the wellbore 102. The drilling tool assembly 104 may include a drill string 105, a bottomhole assembly ("BHA") 106, and a bit 110, attached to the downhole end of drill string 105.

The drill string 105 may include several joints of drill pipe 108 connected end-to-end through tool joints 109. The drill string 105 transmits drilling fluid through a central bore and transmits rotational power from the drill rig 103 to the BHA 106. In some embodiments, the drill string 105 may further include additional components such as subs, pup joints, etc. The drill pipe 108 provides a hydraulic passage through which drilling fluid is pumped from the surface. The drilling fluid discharges through selected-size nozzles, jets, or other orifices in the bit 110 for the purposes of cooling the bit 110 and cutting structures thereon, and for lifting cuttings out of the wellbore 102 as it is being drilled.

The BHA 106 may include the bit 110 or other components. An example BHA 106 may include additional or other components (e.g., coupled between to the drill string 105 and the bit 110). Examples of additional BHA components include drill collars, stabilizers, measurement-while-drilling ("MWD") tools, logging-while-drilling ("LWD") tools, downhole motors, underreamers, section mills, hydraulic disconnects, jars, vibration or dampening tools, other components, or combinations of the foregoing.

In general, the drilling system 100 may include other drilling components and accessories, such as special valves (e.g., kelly cocks, blowout preventers, and safety valves). Additional components included in the drilling system 100 may be considered a part of the drilling tool assembly 104, the drill string 105, or a part of the BHA 106 depending on their locations in the drilling system 100.

The bit 110 in the BHA 106 may be any type of bit suitable for degrading downhole materials. For instance, the bit 110 may be a drill bit suitable for drilling the earth formation 101. Example types of drill bits used for drilling earth formations are fixed-cutter or drag bits. In other embodiments, the bit 110 may be a mill used for removing metal, composite, elastomer, other materials downhole, or combinations thereof. For instance, the bit 110 may be used with a whipstock to mill into casing 107 lining the wellbore 102. The bit 110 may also be a junk mill used to mill away tools, plugs, cement, other materials within the wellbore 102, or combinations thereof. Swarf or other cuttings formed by use of a mill may be lifted to surface, or may be allowed to fall downhole.

Figures 1, 2:
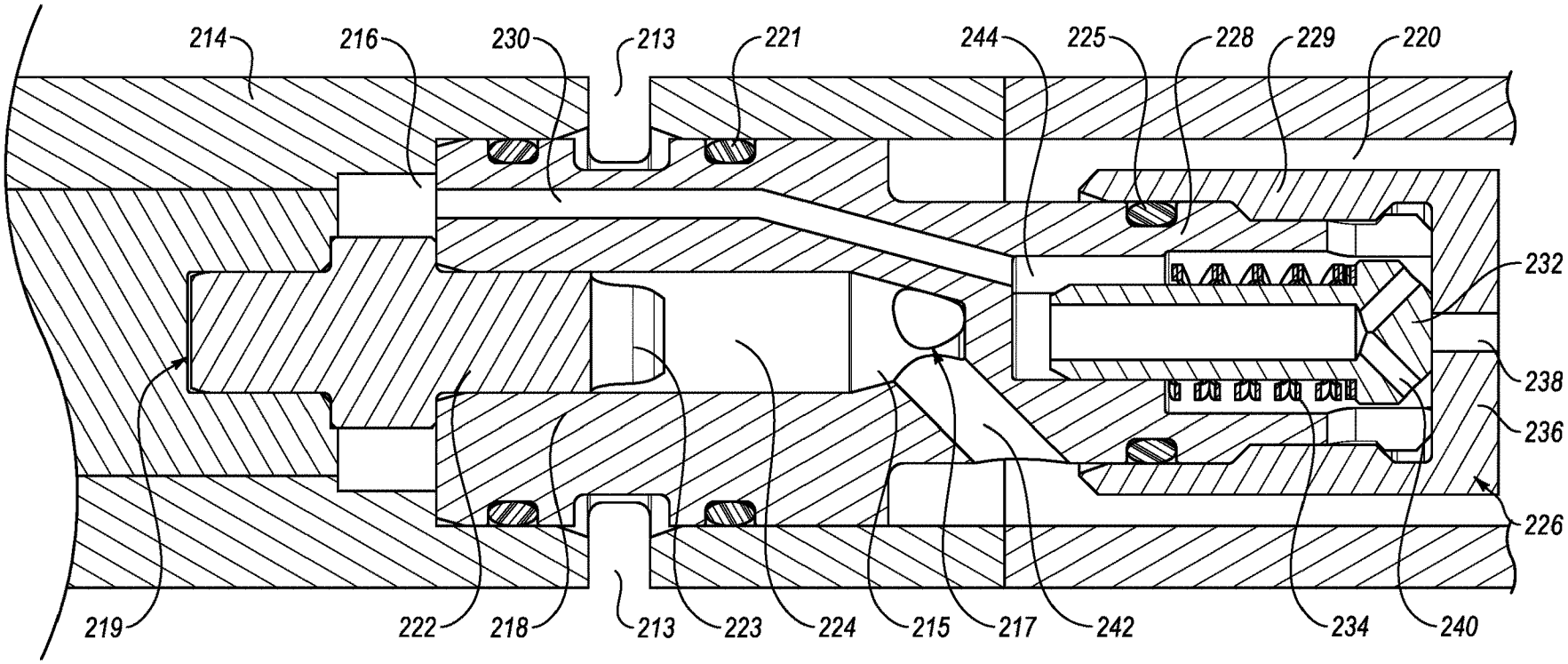
Figure 2:
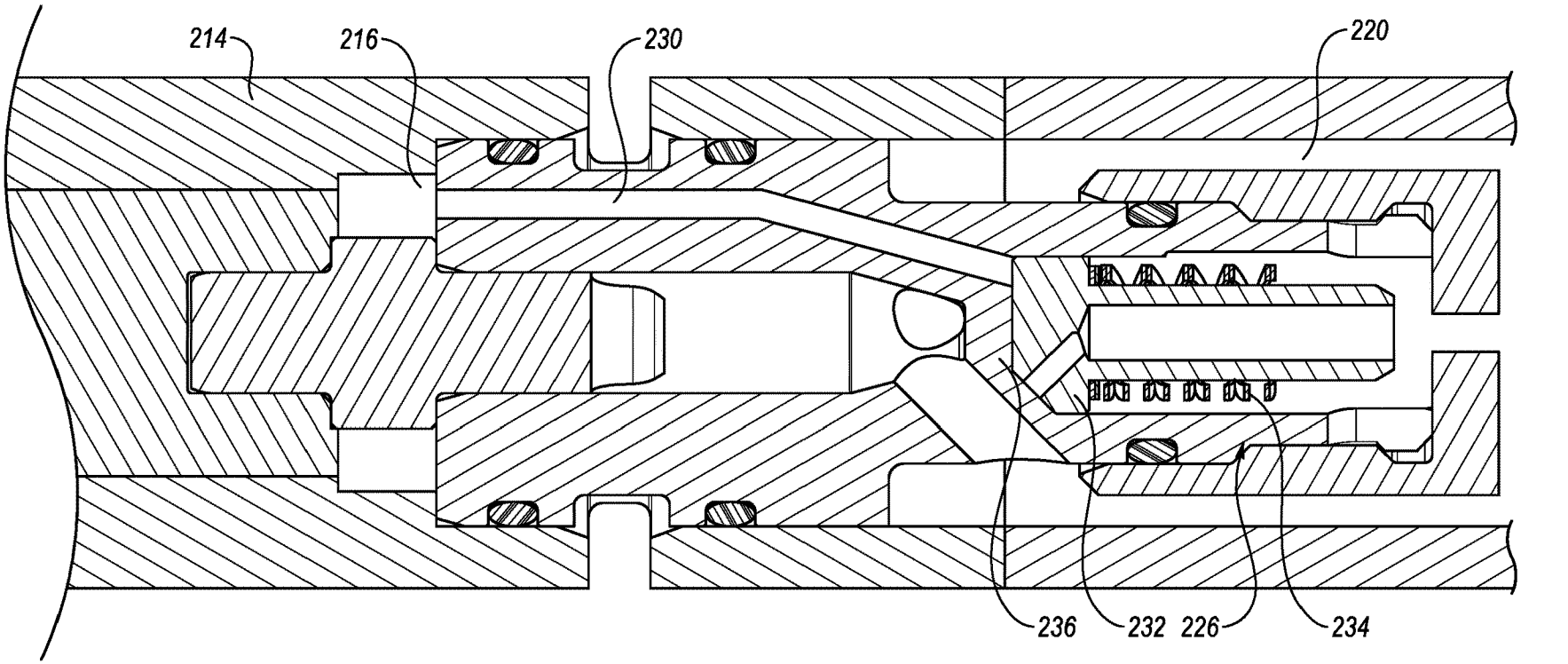

FIG. 2-1 is a representation of an embodiment of a downhole tool 212, according to at least one embodiment of the present disclosure. The downhole tool 212 may include a housing 214. In at least one embodiment, the housing 214 may be a single, unitary structure that encloses other features/components of the present disclosure. In other embodiments, the housing 214 may include two or more structures, connected with mechanical connections, seals, welds, brazes, and other connections, to enclose other features/components of the present disclosure. The housing 214 may include a housing chamber 216 located inside the housing 214. A partition 218 may be located in the housing 214 between the housing chamber 216 and a fluid chamber 220. The partition 218 may be sealed against the housing using one or more rows of sealing members 221, such as an O-ring.

In at least one embodiment, fluid may enter the downhole tool 212 through one or more housing ports 213 located in a sidewall of the housing 214. Fluid entering through the housing ports 213 may engage a movable member 222. For example, the movable member 222 may be a turbine for a power generator, and fluid entering through the housing ports 213 may cause the turbine to rotate. In other examples, the movable member 222 may be a valve, and the valve may block the housing ports 213 in a first valve configuration and open the housing ports 213 in a second valve configuration. The fluid may then be directed to a housing pathway 215 at a housing first end 217. The fluid may exhaust to the fluid chamber 220 from the housing pathway 215. In other embodiments, fluid may enter the housing path and the housing pathway 215 from the fluid chamber 220 and exhaust out the housing ports 213. In at least one embodiment, the housing 214 may be permanently or selectively closed at a housing second end 219.

In the embodiment shown in FIG. 2-1, the movable member 222 may be a rotary valve. The movable member 222 may include one or more flow restrictors 223 at an upper end of the movable member 222. The flow restrictors 223 may extend past a top surface of the movable member 222 along an outer periphery of the movable member 222. In the view shown in FIG. 2-1, the flow restrictors 223 are rotated out of alignment of the housing ports 213. In this manner, the movable member 222 may be in an open configuration, and fluid may flow from the housing ports 213 and into the housing pathway 215, where the fluid may be further directed to other parts of the downhole tool 212 or another location in the BHA.

When the movable member 222 is rotated, the flow restrictors 223 may block or occlude the housing ports 213, thereby cutting off the flow of fluid from the housing pathway 215. For example, the movable member 222 may include two flow restrictors 223 and the downhole tool 212 may include two housing ports 213. As the movable member is rotated 90°, the flow restrictors 223 may block or unblock the housing ports 213. In other examples, the movable member 222 may include a single flow restrictor 223, or more than two flow restrictors 223, including three, four, five, six, seven, or eight flow restrictors. The housing 214 may include the same number of housing ports 213.

The fluid chamber 220 may include any fluid source. For example, the fluid chamber 220 may be located inside of a drill pipe and include drilling fluid located inside of the drill pipe. In other examples, the fluid chamber 220 may be located outside of the drill pipe and include drilling fluid located in an annulus of a wellbore between a drill pipe and the wellbore wall. In still other examples, the fluid chamber 220 may include a hydraulic reservoir pressurized by a hydraulic pump. In some embodiments, the fluid from the fluid chamber 220 may be a water based drilling fluid, an oil based drilling fluid, water, hydraulic oil, or any other fluid.

In at least one embodiment, the partition 218 may prevent the passage of a fluid between the housing chamber 216 and the fluid chamber 220. In other embodiments, the partition 218 may allow the passage of the fluid between the housing chamber 216 and the fluid chamber 220 while preventing the passage of solids or particulates suspended in the fluid. For example, the partition 218 may be a seal between the housing chamber 216 and the partition 218. In some embodiments, the partition 218 may be a seal that maintains a pressure differential between the fluid chamber 220 and the housing chamber 216.

A movable member 222 may be located in the housing 214. The movable member 222 may be translatable or movable relative to the housing 214 through the partition 218. For example, the movable member 222 may be rotatable relative to the housing 214. In other examples, the movable member 222 may be translatable relative to the housing 214. In still other examples, the movable member 222 may be both rotatable and translatable relative to the housing 214.

The movable member 222 may be any component of a downhole tool. For example, the movable member 222 may be a turbine from a power generator. In other examples, the movable member 222 may be a rotor in a rotary valve. In yet other examples, the movable member 222 may be a shuttle in a linear valve. In still other examples, the movable member 222 may be any movable component of a downhole tool.

In at least one embodiment, the partition 218 may be or include a bearing between the movable member 222 and the housing 214. For example, one or both of the partition 218 and the movable member 222 may be manufactured from an ultrahard material. As used herein, the term "ultrahard" is understood to refer to those materials known in the art to have a grain hardness of about 1,500 HV (Vickers hardness in kg/mm2) or greater. Such ultrahard materials can include but are not limited to diamond, sapphire, moissantite, hexagonal diamond (Lonsdaleite), cubic boron nitride (cBN), polycrystalline cBN (PcBN), Q-carbon, binderless PcBN, diamond-like carbon, boron suboxide, aluminum manganese boride, metal borides, boron carbon nitride, PCD (including, e.g., leached metal catalyst PCD, non-metal catalyst PCD, and binderless PCD or nanopolycrystalline diamond (NPD)) and other materials in the boron-nitrogen-carbon-oxygen system which have shown hardness values above 1,500 HV, ultrahard ceramics, as well as combinations of the above materials and/or coatings of any of the above materials on a substrate. In some embodiments, the ultrahard material may have a hardness values above 3,000 HV. In other embodiments, the ultrahard material may have a hardness value above 4,000 HV. In yet other embodiments, the ultrahard material may have a hardness value greater than 80 HRa (Rockwell hardness A). For example, both the partition 218 and the movable member 222 may be made from PCD, and the interface of PCD on PCD has a low coefficient of friction. Thus, the movable member 222 may rotate easily against the partition 218, and may have a long life due to the durability of the movable member 222 and the partition 218. This allows for a tight gap between the movable member 222 and the partition 218. In at least one embodiment, the partition 218 may include an ultrahard bearing surface against which the movable member 222 may move.

The housing 214 may include a passageway 224 through the partition 218 that hydraulically connects the fluid chamber 220 to the housing chamber 216. The partition 218 has a partition dimension. The movable member 222 has movable member dimension. The movable member 222 may be inserted into the partition 218. A gap may exist between the movable member 222 and the partition 218, which may be the difference between the partition dimension and the movable member dimension. For example, in at least one implementation, a cylindrical movable member 222 may be inserted into a cylindrical bore of the partition 218. The partition dimension may be a diameter of the cylindrical bore, and the movable member dimension may be a diameter of the movable member 222. The gap may be the difference between the diameter of the cylindrical bore and the diameter of the movable member 222. In at least one implementation, the gap may be considered a tolerance between the partition 218 and the movable member 222.

A tight gap between the movable member 222 and the partition 218 may form a seal between the fluid chamber 220 and the housing chamber 216. The movable member 222 may be inserted into the passageway 224. In at least one embodiment, the movable member 222 and the partition 218 may form a seal between the fluid chamber 220 and housing chamber 216. This seal may partially or completely reduce the flow of fluid between the fluid chamber 220 and the housing chamber 216. The seal may be formed by a tight gap between the movable member 222 and the partition 218. In some embodiments, the gap between the movable member 222 and the partition 218 may be in a range having an upper value, a lower value, or upper and lower values including any of 0 micrometers (μm), 5 μm, 10 μm, 20 μm, 30 μm, 40 μm, 50 μm, 60 μm, 70 μm, 80 μm, 90 μm, 100 μm, 200 μm, 300 μm, 400 μm, 500 μm, or any value therebetween. For example, the gap may be 0 μm, or fully sealed. In another example, the gap may be less than 500 μm. In yet other examples, the gap may be any value in a range between fully sealed and 500 μm. In at least one embodiment, a gap of 20 μm or less may be critical to prevent particulates from migrating between the fluid chamber 220 and the housing chamber 216.

The partition 218 may include seal that maintains a pressure differential between the fluid chamber 220 and the housing chamber 216. Thus, a pressure differential may exist across the movable member 222. In at least one embodiment, the tight gap between the movable member 222 and the partition 218 may contribute to maintaining the pressure differential due to the restricted fluid flow between the fluid chamber 220 and the housing chamber 216. A greater gap may result in a lower pressure differential, and a lower gap may result in a higher pressure differential.

In at least one embodiment, as the movable member 222 is rotated or translated with respect to the partition 218, at least some fluid may transfer between the fluid chamber 220 and the housing chamber 216. Fluid transfer between the fluid chamber 220 and the housing chamber 216 may adjust the pressure differential. In this manner, as the movable member 222 moves relative to the partition 218, a steady-state pressure differential may be achieved, despite changing drilling conditions, such as an increase in hydrostatic pressure. Furthermore, the movement of the movable member 222 relative to the partition 218 may prevent a build-up of particulates or solids suspended in the fluid at the interface between the movable member and the partition 218. In other words, moving the movable member 222 may flush out the gap between the movable member 222 and the partition 218.

When the movable member 222 is not moving relative to the partition 218, as the pressure differential increases, fluid may be forced through the gap between the movable member 222 and the partition 218. In some embodiments, as the fluid is being forced through the gap, the particulates or solids suspended in the fluid may not be flushed from the gap. These particulates or solids may build up at the gap. As the particulate or solid build-up increases, less fluid may transfer through the gap. This may cause the pressure differential to increase. In at least one embodiment, sufficient particulates or solids may build up until the gap is clogged, or effectively sealed off. Thus, as the pressure differential across the movable member 222 increases, fluid may not be able to transfer between the fluid chamber 220 and the housing chamber to adjust the pressure differential.

The movable member 222 may not move relative to the partition 218 in a variety of situations. For example, while tripping the downhole tool 212 into a wellbore, the movable member 222 may not move relative to the partition 218. At the surface, both the housing chamber 216 and the fluid chamber 220 may be at or near the same pressure (e.g., surface pressure). In other words, at the surface the pressure differential may be zero or approximately zero. As the downhole tool 212 is tripped into the hole, the hydrostatic pressure increases. When particulates in the drilling fluid clog the gap, the pressure differential may increase at or near the same rate as the hydrostatic pressure. Furthermore, geologic pressure of the surrounding formation may begin to add to the hydrostatic pressure creating a combined pressure. In some embodiments, the combined pressure, and therefore the pressure differential, may be equal to or greater than 5,000 PSI (34.5 MPa), 10,000 PSI (68.9 MPa), 15,000 PSI (103 MPa), 20,000 PSI (138 MPa), 25,000 PSI (172 MPa), 30,000 PSI (207 MPa), or greater.

The pressure differential may place a load on the movable member 222 against the housing 214 and/or the partition 218. This load may increase the initial force required to move the movable member 222. In some embodiments, the initial force may be greater than an actuation force. For example, if the movable member 222 is a turbine on a power generator, the movable member 222 may be rotatable by the drilling fluid. The drilling fluid may exert a torque on the movable member 222. If the initial force required to move the movable member 222 is greater than the torque exerted by the drilling fluid, then the movable member 222 may be stuck. In other words, a large pressure differential may pressure lock the movable member 222. This may cause the downhole tool 212 to malfunction. The pressure differential below which the downhole tool 212 may reliably function may be a maximum pressure differential.

In some embodiments, the maximum pressure differential may be in a range having an upper value, a lower value, or upper and lower values including any of 50 PSI (345 KPa), 100 PSI (689 KPa), 250 PSI (1.72 MPa), 500 PSI (3.44 MPa), 750 PSI (5.17 MPa), 1,000 PSI (6.89 MPa), 1,250 PSI (8.62 MPa), 1,500 PSI (10.3 MPa), 1,750 PSI (12.1 MPa), 2,000 PSI (13.8 MPa), 2,250 PSI (15.5 MPa), 2,500 PSI (17.2 MPa), 3,000 PSI (20.7 MPa), 4,000 PSI (27.6 MPa), 5,000 PSI (34.5 MPa), 10,000 PSI (68.9 MPa), 15,000 PSI (103 MPa), 20,000 PSI (138 MPa), or any value therebetween. For example, the maximum pressure differential may be greater than 50 PSI (345 KPa). In another example, the maximum pressure differential may be less than 20,000 PSI (138 MPa). In yet other examples, the maximum pressure differential may be any value in a range between 50 PSI (345 KPa) and 20,000 PSI (138 MPa). In some embodiments, the maximum pressure differential may be greater than 20,000 PSI (138 MPa) or less than 50 PSI (345 KPa). In some embodiments, a maximum pressure differential below 5,000 PSI may be critical for the movable member 222 to reliably move upon actuation. In some embodiments, the maximum pressure differential may be the same or approximately the same as an operating pressure of the downhole tool 212. In other embodiments, the maximum pressure differential may be greater than the operating pressure of the downhole tool 212.

A pressure adjuster 226 may be connected to the partition 218 and/or the housing 214. The pressure adjuster 226 may maintain the pressure differential below the maximum pressure differential. In other words, the pressure adjuster 226 may automatically adjust the pressure differential to below the maximum pressure differential. In some embodiments, the pressure adjuster 226 may include an adjuster housing 228 including a flow path 230. The adjuster housing 228 may extend from and be connected to the partition 218, or be integrally formed with the partition 218. An adjuster housing cap 229 may be placed over the adjuster housing 228. The adjuster housing 228 may be sealed to the adjuster housing cap 229 with one or more adjuster sealing members 225, such as an O-ring. The adjuster sealing members 225 may seal the interior of the adjuster housing 228, such as the flow path 230, from the fluid chamber 220. The flow path 230 may travel through the adjuster housing 228, into the partition 218 and open into the housing chamber 216. The flow path 230 may include an adjuster chamber 244 in the adjuster housing 228. The adjuster chamber 244 may be in fluid communication with the housing chamber 216 and the fluid chamber 220. In other words, the adjuster chamber 244 may be located in the flow path 230 between the housing chamber and the fluid chamber 220.

A flow restrictor 232 may be located in the adjuster chamber 244. In some embodiments, the flow restrictor 232 may be cylindrical, such as a piston. In other embodiments, the flow restrictor 232 may be spherical. In still other embodiments, the flow restrictor 232 may be conical or pyramidal. In yet other embodiments, the flow restrictor 232 may be any three-dimensional shape.

A resilient member 234 may exert a force on the flow restrictor 232 to urge or push the flow restrictor 232 against a seat 236. The seat 236 may be located at a high pressure side of the adjuster chamber 244, and may be a part of or integral to the adjuster housing 228. The resilient member 234 may be any type of resilient member. For example, the resilient member 234 may be one or more coil springs, one or more wave springs, one or more Belleville washers, one or more pneumatic or hydraulic pistons, a bellows, a flexible material such as an elastomer, any other resilient member 234, or combinations of the foregoing.

The resilient member 234 may urge or push the flow restrictor 232 against the seat 236 with a force sufficient to seal the flow path 230 from fluid passing between the fluid chamber 220 and the housing chamber 216. For example, an opening 238 of the flow path 230 at the seat 236 may have an opening cross-sectional area. The portion of the flow restrictor 232 that contacts the seat 236 may have a restrictor cross-sectional area that is larger than the opening cross-sectional area. Therefore, as the resilient member 234 pushes the flow restrictor 232 against the seat 236, the flow restrictor 232 may partially or fully block the transfer of fluid between the fluid chamber 220 and the housing chamber 216.

The resilient member force with which the resilient member 234 pushes the flow restrictor 232 against the seat 236 may be sufficient to overcome the pressure differential between the fluid chamber 220 and the housing chamber 216. In at least one embodiment, the force of the resilient member 234 may at least partially depend on the opening cross-sectional area. For example, a larger opening 238 cross-sectional area may require a lower force to seal the opening 238 than a smaller opening cross-sectional area. The resilient member 234 may be specifically selected or sized to apply a resilient member force that may seal the opening 238.

As the pressure differential increases, the hydraulic force on the flow restrictor 232 due to the pressure differential may overcome the resilient member force, thereby pushing the flow restrictor 232 into the adjuster chamber 244. This may allow fluid to enter the flow path 230. In at least one embodiment, one or more flow restrictor fluid paths 240 may be located internal to the flow restrictor 232. The one or more flow restrictor fluid paths 240 may pass all the way through the flow restrictor, from a first side of the flow restrictor 232 near the seat 236 to the opposite side, or a second side of the flow restrictor 232 near the housing chamber 216. Thus, the flow restrictor 232 may have a pass-through fluid conduit, which may hydraulically connect the fluid chamber 220 to the housing chamber 216. In other embodiments, fluid may pass around an outside of the flow restrictor 232, or in an annulus in the flow path 230 between the flow restrictor and the adjuster housing 228. In some embodiments, fluid may pass through both the flow restrictor fluid paths 240 in the flow restrictor 232 and around the outside of the flow restrictor 232.

When the flow restrictor 232 is pushed against the seat 236, flow to the flow restrictor fluid paths 240 may be blocked. As the pressure differential increases, the flow restrictor 232 may move into the adjuster chamber 244 in response to the pressure differential. As the flow restrictor 232 is pushed into the flow path 230, fluid may enter one or more of the flow restrictor fluid paths 240. This may cause the pressure differential to decrease. As the pressure differential decreases, the resilient member 234 may overcome the force applied by the lowered pressure differential, and seal the flow path 230 again. Thus, the resilient member 234 may be selected to maintain a relief pressure differential, or a pressure differential above which the pressure differential force is sufficient to overcome the resilient member force. Above the relief pressure differential, the pressure adjuster may relieve the pressure differential between the fluid chamber 220 and the housing chamber 216. Therefore, in some embodiments, the pressure adjuster 226 may be a pressure-relief valve.

In some embodiments, the relief pressure differential may be in a range having an upper value, a lower value, or upper and lower values including any of 50 PSI (345 KPa), 100 PSI (689 KPa), 250 PSI (1.72 MPa), 500 PSI (3.44 MPa), 750 PSI (5.17 MPa), 1,000 PSI (6.89 MPa), 1,250 PSI (8.62 MPa), 1,500 PSI (10.3 MPa), 1,750 PSI (12.1 MPa), 2,000 PSI (13.8 MPa), 2,250 PSI (15.5 MPa), 2,500 PSI (17.2 MPa), 3,000 PSI (20.7 MPa), 4,000 PSI (27.6 MPa), 5,000 PSI (34.5 MPa), 10,000 PSI (68.9 MPa), 15,000 PSI (103 MPa), 20,000 PSI (138 MPa), or any value therebetween. For example, the relief pressure differential may be greater than 50 PSI (345 KPa). In another example, the relief pressure differential may be less than 20,000 PSI (138 MPa). In yet other examples, the relief pressure differential may be any value in a range between 50 PSI (345 KPa) and 20,000 PSI (138 MPa). In some embodiments, maximum pressure differential values below 5,000 PSI may be critical to allow the movable member 222 to move upon actuation of the downhole tool 212. In some embodiments, the relief pressure differential may be the same or approximately the same as the maximum pressure differential. In some embodiments, the relief pressure differential may be less than the maximum pressure differential and greater than the operating pressure differential of the downhole tool 212. In this manner, as the downhole tool 212 is tripped into a wellbore, the pressure differential may remain low enough that the downhole tool 212 may be actuated despite a large hydrostatic pressure, or a large difference in pressure between a starting location (e.g., the surface) and an operating location (e.g., downhole).

In at least one embodiment, the adjuster housing 228 may be located outside of the partition 218. For example, the adjuster housing 228 may be attached to the end of the partition 218 away from the housing 214. In other words, the pressure adjuster 226 may be independent of the housing 214 and/or the partition 218. This means that the pressure adjuster 226 may be located in its own structure, the adjuster housing 228. To allow fluid to travel between the housing ports 213 and the fluid chamber 220, one or more branching conduits 242 may be placed in the adjuster housing 228 to direct fluid between the housing ports 213 and the fluid chamber 220.

In the embodiment shown in FIG. 2-1, the pressure adjuster 226 is uni-directional, or operates to relieve pressure from a fluid chamber 220 that has a higher pressure than the housing chamber 216. This pressure differential may occur, for example, when tripping the downhole tool 212 deeper into a wellbore.

FIG. 2-2 shows an embodiment of a downhole tool 212 where the pressure adjuster 226 operates to relieve pressure from a housing chamber that has a higher pressure than the fluid chamber. In this embodiment, the flow restrictor 232 may be flipped around with respect to the flow restrictor 232 shown in FIG. 2-1 so that it seals against a seat 236 located near the housing 214. A resilient member 234 may push the flow restrictor 232 against the seat 236 to seal the flow path 230 with a relief pressure differential. As the pressure in the housing chamber 216 increases, the pressure may push the flow restrictor away from the seat 236, thereby allowing some fluid to escape into the fluid chamber 220. In this manner, the housing chamber 216 may be the high pressure side and the fluid chamber 220 may be the low pressure side. This pressure differential may occur, for example, when tripping the downhole tool up toward the surface.

In some embodiments, the downhole tool 212 may include two pressure adjusters 226, including one each of the pressure adjusters shown in FIG. 2-1 and FIG. 2-2. In this manner, the downhole tool 212 may maintain a relief pressure differential while tripping both uphole and downhole. In some embodiments, a single pressure adjuster may be a two way valve that maintains a relief pressure differential while tripping both uphole and downhole.

Figures 1, 3:
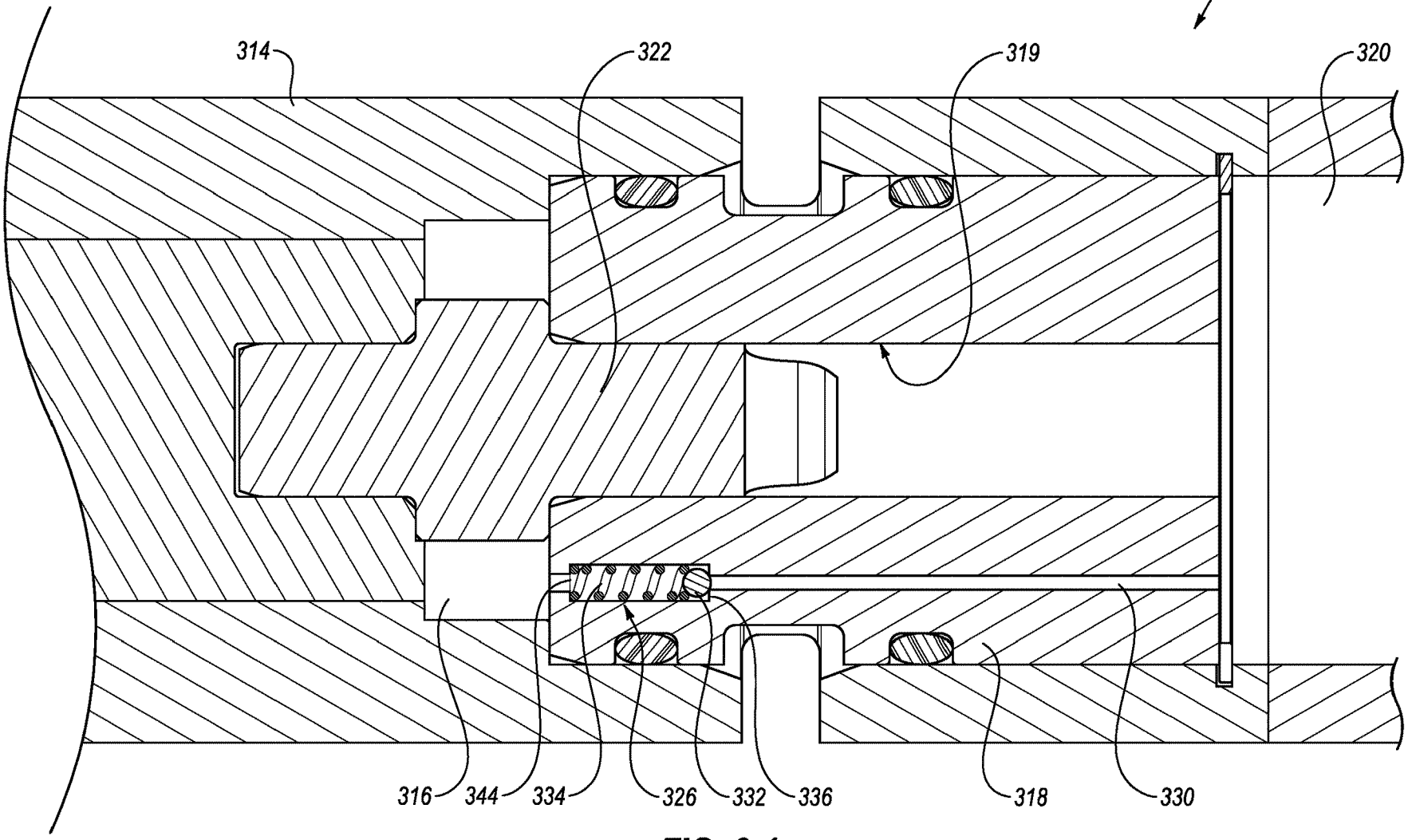
Figures 2, 3:
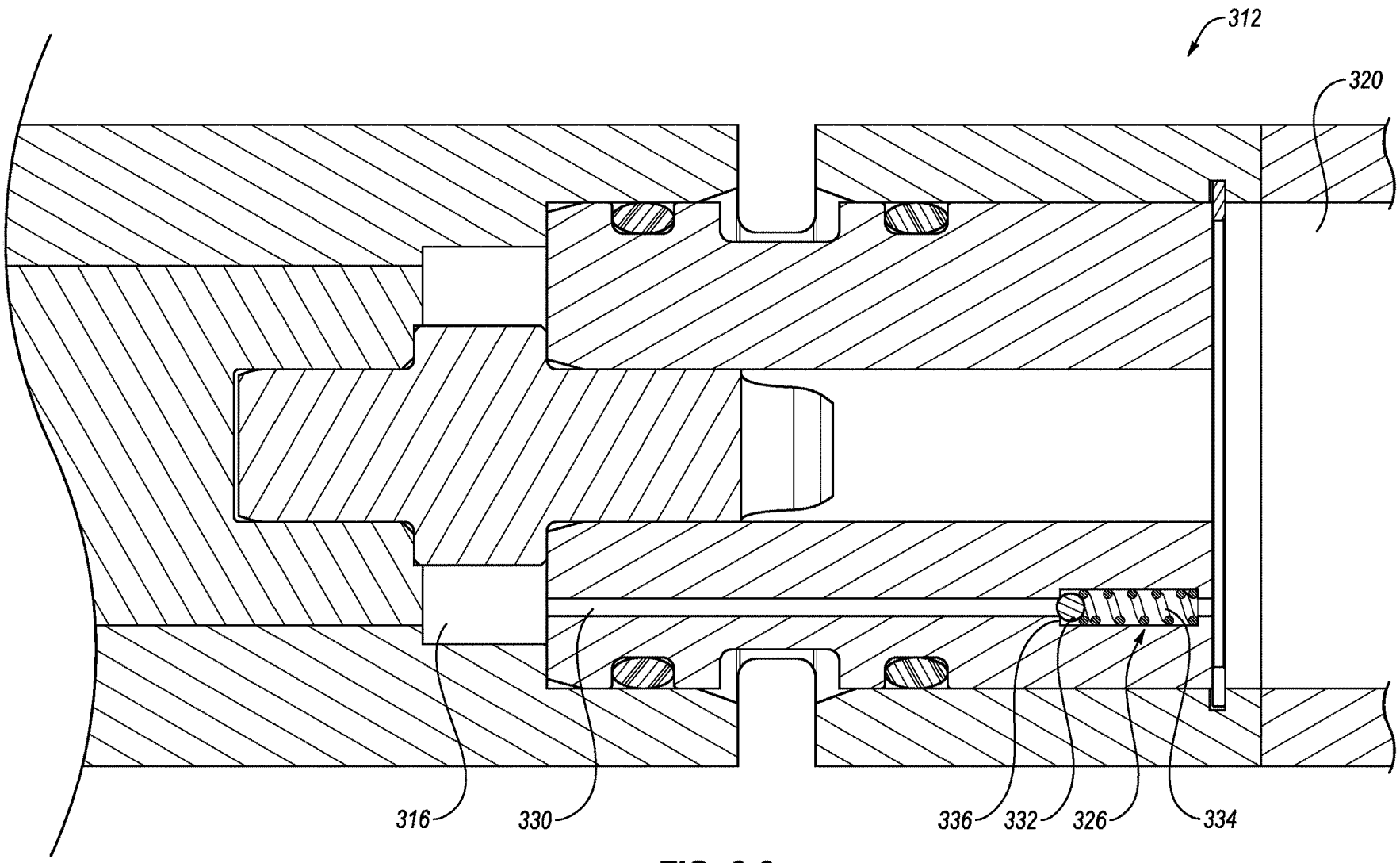

FIG. 3-1 is a representation of a downhole tool 312, according to at least one embodiment of the present disclosure. The downhole tool 312 may include a housing 314 and a housing chamber 316 inside the housing 314. A partition 318 in the housing 314 may seal the housing chamber 316 from a fluid chamber 320. In at least one embodiment, the partition 318 may include a bearing surface 319. The bearing surface 319 may be fabricated from PCD. The movable member 322 may be fabricated from PCD. The bearing surface 319 may directly abut against the movable member 322 such that as the movable member moves relative to the housing 314, the movable member 322 slides against the bearing surface 319. Because the bearing surface 319 and the movable member 322 are fabricated from PCD, the movable member 322 may be inserted into the housing 314 against the bearing surface 319 with a tight gap. The tight gap between the bearing surface 319 and the movable member 322 may form a full or a partial seal between the fluid chamber 320 and the housing chamber 316.

A flow path 330 may be located in the partition 318 providing hydraulic communication between the housing chamber 316 and the fluid chamber 320. A pressure adjuster 326 may be located in the flow path 330. The pressure adjuster may include a flow restrictor 332 located in an adjuster chamber 344 located in the flow path 330. A resilient member 334 may push the flow restrictor 332 against a seat 336 in the adjuster chamber 344 with sufficient force to seal the flow path 330 with a relief pressure differential. In the embodiment shown, the resilient member 334 is a spherical ball that may sit against a circular seat 336. In other embodiments, the resilient member 334 may be a cylindrical piston (as shown in FIGS. 2-1 and 2-2), or any other shape that may form a seal with the seat 336.

When the pressure differential between the fluid chamber 320 and the housing chamber 316 is greater than the relief pressure differential, the flow restrictor 332 may be pushed away from the seat 336. Fluid may then pass through or around the flow restrictor 332 and into the housing chamber 316. This may reduce the pressure differential to below the relief pressure differential such that the resilient member 334 pushes the flow restrictor 332 back against the seat. In the embodiment shown in FIG. 3-1, the pressure adjuster 326 is configured to adjust the pressure from a high-pressure fluid chamber 320 to a low-pressure housing chamber 316. In at least one embodiment, including the pressure adjuster 326 in the partition 318 may reduce the length of the downhole tool 312 and/or reduce the complexity of manufacturing the downhole tool 312.

In some embodiments, the downhole tool 312 may include a plurality of pressure adjusters 326. For example, two or more pressure adjusters 326 may be installed in series in the flow path 330. In other words, the same flow path 330 may include two or more pressure adjusters 326 installed one after the other. Several pressure adjusters 326 in series may provide for a more precise adjustment of the relief pressure differential and/or the maximum pressure differential. Further, pressure adjusters 326 in series may dampen the pressure increases experienced by the housing chamber 316 if the fluid chamber 320 experiences a rapid increase in hydrostatic or other pressure.

In other examples, two or more pressure adjusters 326 may be installed in parallel. In other words, the partition 318 may include two or more flow paths 330, with each flow path 330 including a pressure adjuster 326. This may allow for a larger volume of fluid to pass between the fluid chamber 320 and the housing chamber 316. This may allow the pressure differential to reach the maximum pressure differential rapidly if the fluid chamber 320 experiences a rapid increase in hydrostatic or hydraulic pressure.

In at least one example, the downhole tool may include pressure adjusters 326 in both series and parallel. In some examples, at least one of the pressure adjusters 326 may be the pressure adjuster shown in FIG. 2-1 and/or FIG. 2-2, in series or in parallel with another pressure adjuster 326.

FIG. 3-2 is a representation of a downhole tool 312, according to at least one embodiment of the present disclosure. In the embodiment shown, a pressure adjuster 326 may include a resilient member 334 that pushes a flow restrictor 332 toward a seat 336 near the housing chamber 316. In this manner, the pressure adjuster may relieve a pressure from the housing chamber 316 to the fluid chamber 320.

In some embodiments, the downhole tool 312 may include a plurality of pressure adjusters 326. For example, two or more pressure adjusters 326 may be installed in series in the flow path 330. In other words, the same flow path 330 may include two or more pressure adjusters 326 installed one after the other. Several pressure adjusters 326 in series may provide for a more precise adjustment of the relief pressure differential and/or the maximum pressure differential. Further, pressure adjusters 326 in series may dampen the pressure decrease in the housing chamber 316 if the fluid chamber 320 experiences a rapid decrease in hydrostatic or hydraulic pressure.

In other examples, two or more pressure adjusters 326 may be installed in parallel. In other words, the partition 318 may include two or more flow paths 330, with each flow path 330 including a pressure adjuster 326. This may allow for a larger volume of fluid to pass between the fluid chamber 320 and the housing chamber 316. This may allow the pressure differential to reach the maximum pressure differential rapidly if the fluid chamber 320 experiences a rapid decrease in hydrostatic or hydraulic pressure.

Figure 4:
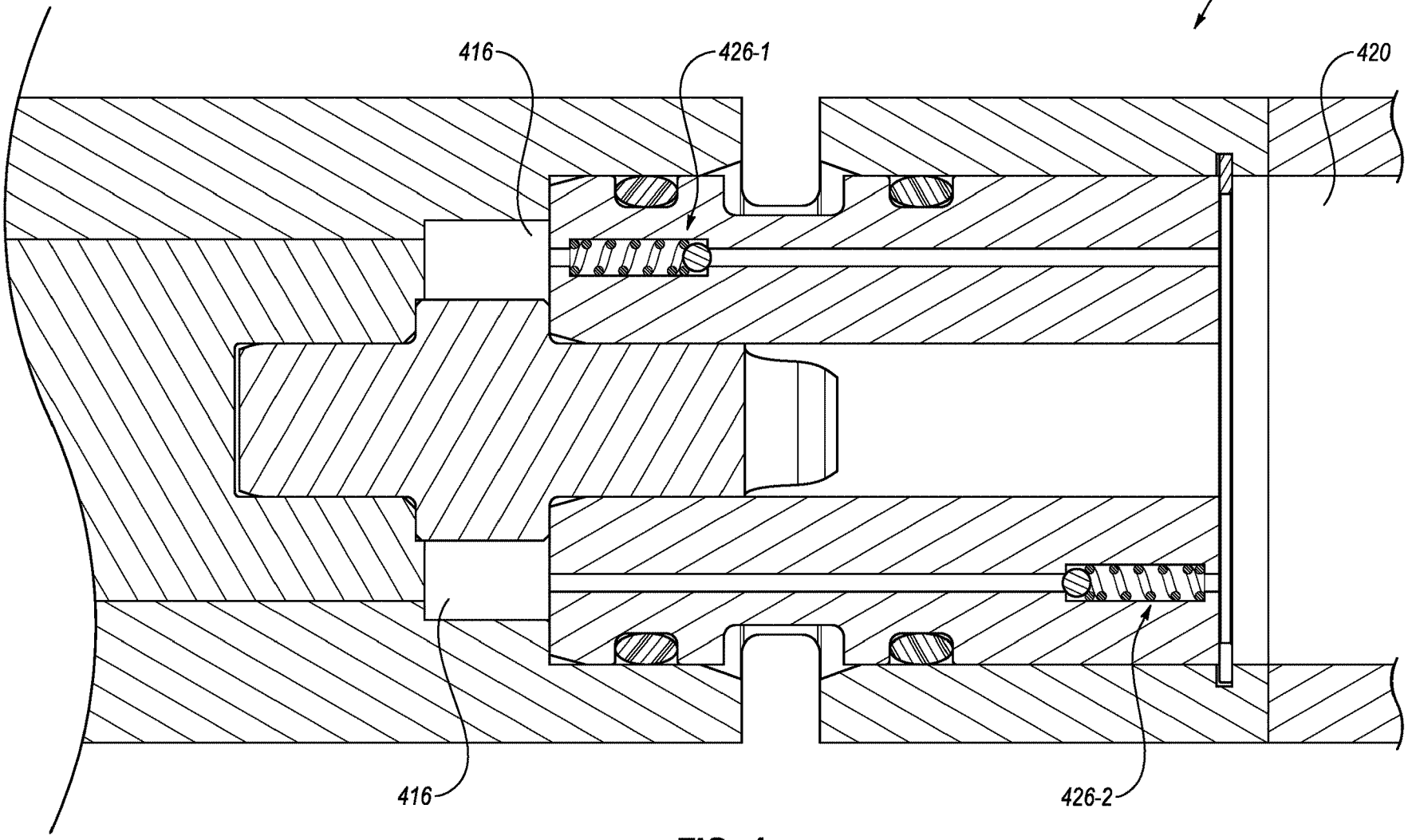
FIG. 4 is a cross-sectional view of a further pressure adjuster on a downhole tool, according to at least one embodiment of the present disclosure.

FIG. 4 is a representation of a downhole tool 412, according to at least one embodiment of the present disclosure. The downhole tool 412 may include at least some of the features and characteristics of the downhole tools described with respect to FIG. 2-1 through FIG. 3-2. The downhole tool 412 may include two pressure adjusters 426-1, 426-2. A first pressure adjuster 426-1 may be configured to adjust the pressure differential from a high pressure fluid chamber 420 to a low pressure housing chamber 416 (similar to the pressure adjuster 226 of FIGS. 2-1 and 326 of FIG. 3-1). A second pressure adjuster 426-2 may be configured to adjust the pressure differential from a high pressure housing chamber 416 to a low pressure fluid chamber 420. Thus, the downhole tool 412 may maintain the maximum pressure differential regardless of whether the housing chamber 416 or the fluid chamber 420 has a higher pressure. In some embodiments, either the first pressure adjuster 426-1 or the second pressure adjuster 426-2, or both, may have multiple pressure adjusters in series or in parallel.

Figure 5:
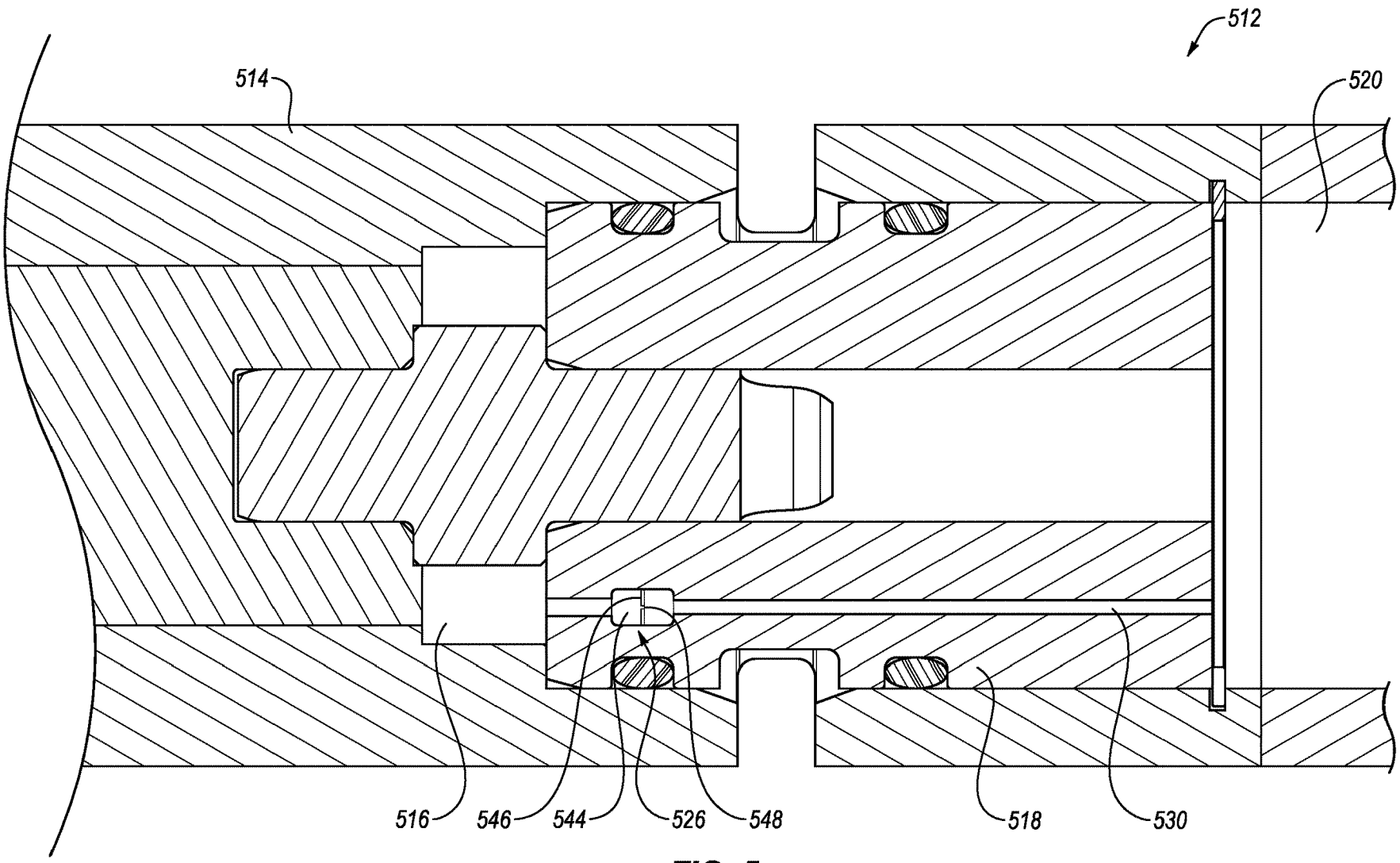
FIG. 5 is a cross-sectional view of a still further pressure adjuster on a downhole tool, according to at least one embodiment of the present disclosure.

FIG. 5 is a representation of an embodiment of a downhole tool 512, according to at least one embodiment of the present disclosure. The downhole tool 512 may include a flow path 530 through a partition 518 in a housing 514. The flow path 530 may place a housing chamber 516 and a fluid chamber 520 in fluid communication. The flow path 530 may include a pressure adjuster 526. The pressure adjuster 526 may include an adjuster chamber 544. The adjuster chamber may include a diaphragm 546. The diaphragm 546 may be made from any resilient material, such as elastomer, rubber, spring steel, plastic, or any other resilient material. The diaphragm 546 may have a modulus of elasticity such that it flexes in the presence of a differential pressure. The diaphragm 546 may include an aperture 548. As the diaphragm 546 flexes in response to the pressure differential, the diaphragm 546 may open an aperture 548. When the aperture 548 is opened, fluid may travel between the fluid chamber 520 and the housing chamber 516. The modulus of elasticity of the diaphragm 546 may therefore be selected to open the aperture at a relief pressure differential. Thus, the diaphragm 546 may be a pressure relief valve.

Because the diaphragm 546 is flexible both from the fluid chamber 520 to the housing chamber 516 and from the housing chamber 516 to the fluid chamber 520, the diaphragm 546 may allow bi-directional communication of fluid between the fluid chamber 520 and the housing chamber 516. In this manner, the pressure adjuster 526 may be bi-directional.

Figure 6:
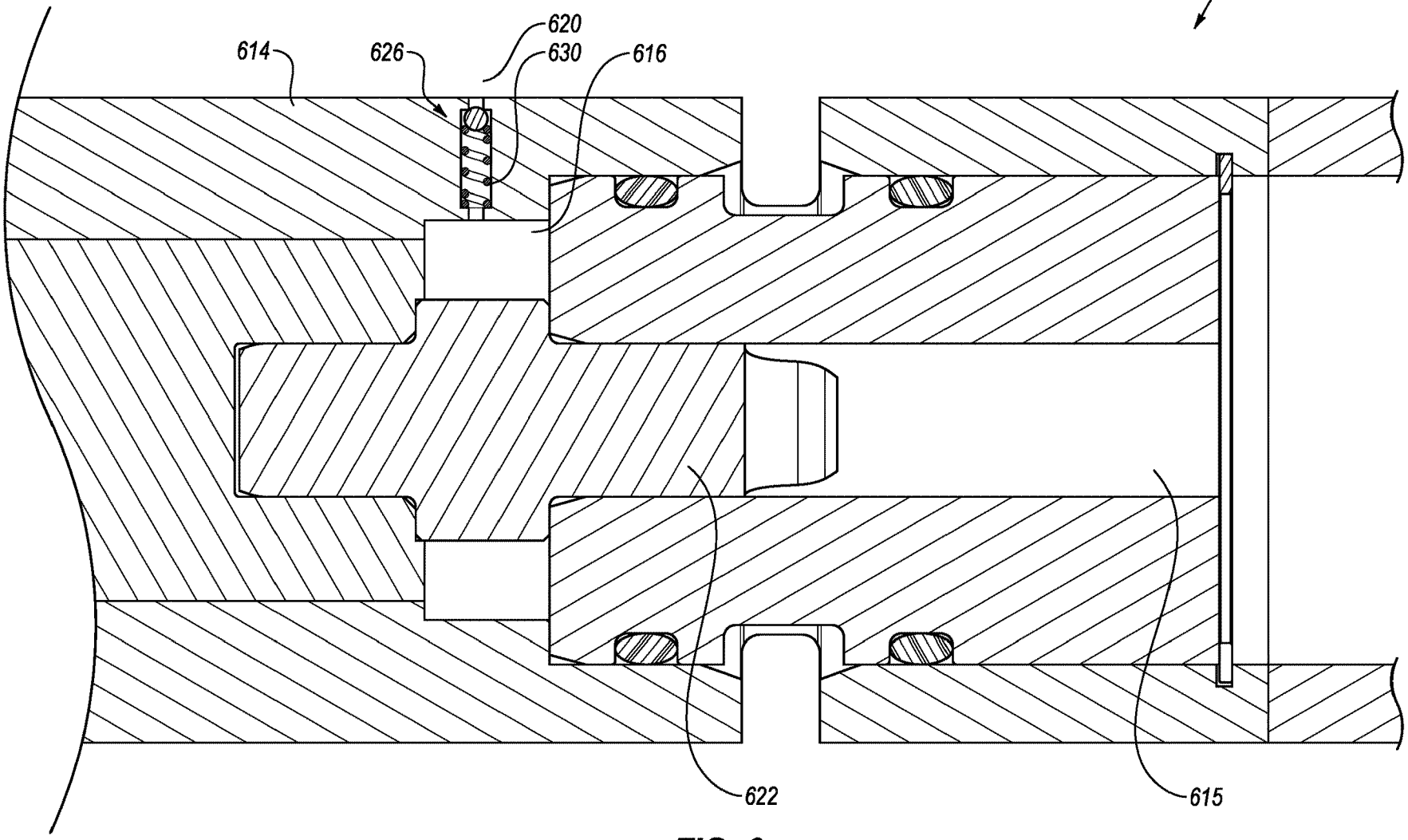
FIG. 6 is a cross-sectional view of a yet further pressure adjuster on a downhole tool, according to at least one embodiment of the present disclosure.

FIG. 6 is a representation of an embodiment of a downhole tool 612, according to at least one embodiment of the present disclosure. The downhole tool 612 may include at least some of the features and characteristics of the downhole tools described with respect to FIG. 2-1 through FIG. 5. In some embodiments, the downhole tool 612 may include a pressure adjuster 626 in any location that allows a flow path 630 to communicate fluid between a fluid chamber 620 and a housing chamber 616. For example, in the embodiment shown, the pressure adjuster 626 may be located in a housing 614. In this embodiment, the pressure adjuster 626 and the flow path 630 may be transverse to the movable member 622 and/or the housing pathway 615. In other embodiments, the pressure adjuster 626 may be located at any other location that a flow path 630 may be created between the fluid chamber 620 and the housing chamber 616.

Figure 7:
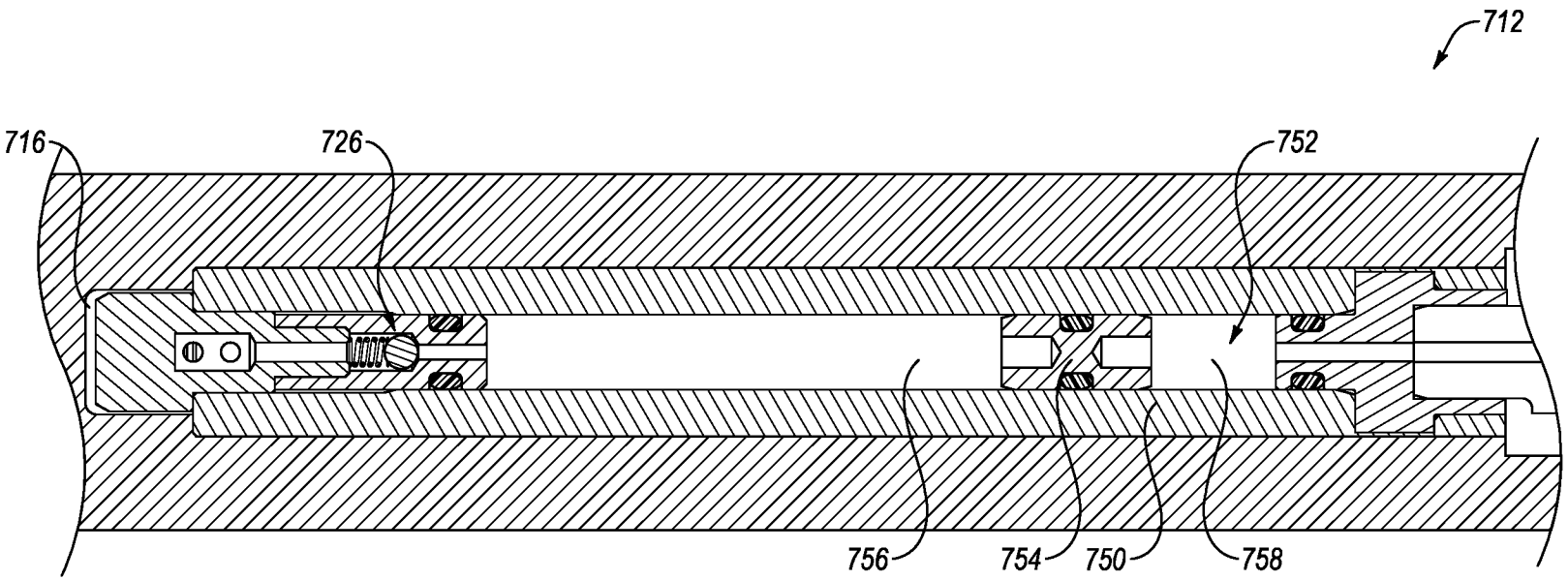
FIG. 7 is a cross-sectional view of another pressure adjuster on a downhole tool, according to at least one embodiment of the present disclosure.

FIG. 7 is an embodiment of a downhole tool 712, according to at least one embodiment of the present disclosure. The downhole tool 712 may include at least some of the features and characteristics of the downhole tools described with respect to FIG. 2-1 through FIG. 6. The downhole tool 712 may include a pressure adjuster 726. A piston 750 may be connected to the pressure adjuster 726. The piston may include an inner bore 752. A sealing member 754 may be located in the inner bore 752. The sealing member 754 may divide the inner bore 752 into two sections, a fluid reservoir 756 on a first side of the inner bore 752 near the pressure adjuster 726 and a pressurized fluid 758 on a second side of the inner bore 752 near a fluid chamber (not shown) of the downhole tool 712. The sealing member 754 may seal the fluid reservoir 756 from the pressurized fluid 758.

As the pressure of the pressurized fluid 758 increases, pressurized fluid 758 may push the sealing member 754 towards the pressure adjuster 726. This may increase the pressure of the fluid in the fluid reservoir 756. When the pressure in the fluid reservoir 756 exceeds the relief pressure differential of the pressure adjuster 726, fluid from the fluid reservoir 756 may enter the housing chamber 716, thereby decreasing the pressure differential.

The fluid reservoir 756 may include any fluid. In some embodiments, the fluid in the fluid reservoir 756 may be an oil based fluid, such as hydraulic oil or oil-based drilling fluid. In other embodiments the fluid in the fluid reservoir 756 may be a water based fluid, such as a water-based drilling fluid. In still other embodiments, the fluid reservoir 756 may include a lubricant, such as grease. Because fluid from the fluid reservoir 756 is the only fluid that is inserted into the housing chamber 716 during pressure adjustment, including a piston 750 with the pressure adjuster 726 may allow control over the fluid that enters the housing chamber 716 while the pressure adjuster 726 adjusts the pressure. This may help to keep the downhole tool 712 clean and ensure that it operates properly.

In some embodiments, the piston 750 may be a single-stroke piston. In other words, when the sealing member 754 reaches the pressure adjuster 726, then no more of the fluid from the fluid reservoir 756 may enter the housing chamber 716. In some embodiments, the piston 750 may expand in cross-sectional area near the pressure adjuster 726. In this manner, when the sealing member 754 reaches the pressure adjuster 726, fluid from the pressurized fluid 758 may travel around the sealing member 754 to reach the pressure adjuster. In other embodiments, the sealing member 754 may include a pressure relief valve, a burst disc, or other mechanism to allow fluid to flow through the sealing member 754.

Figures 1, 8:
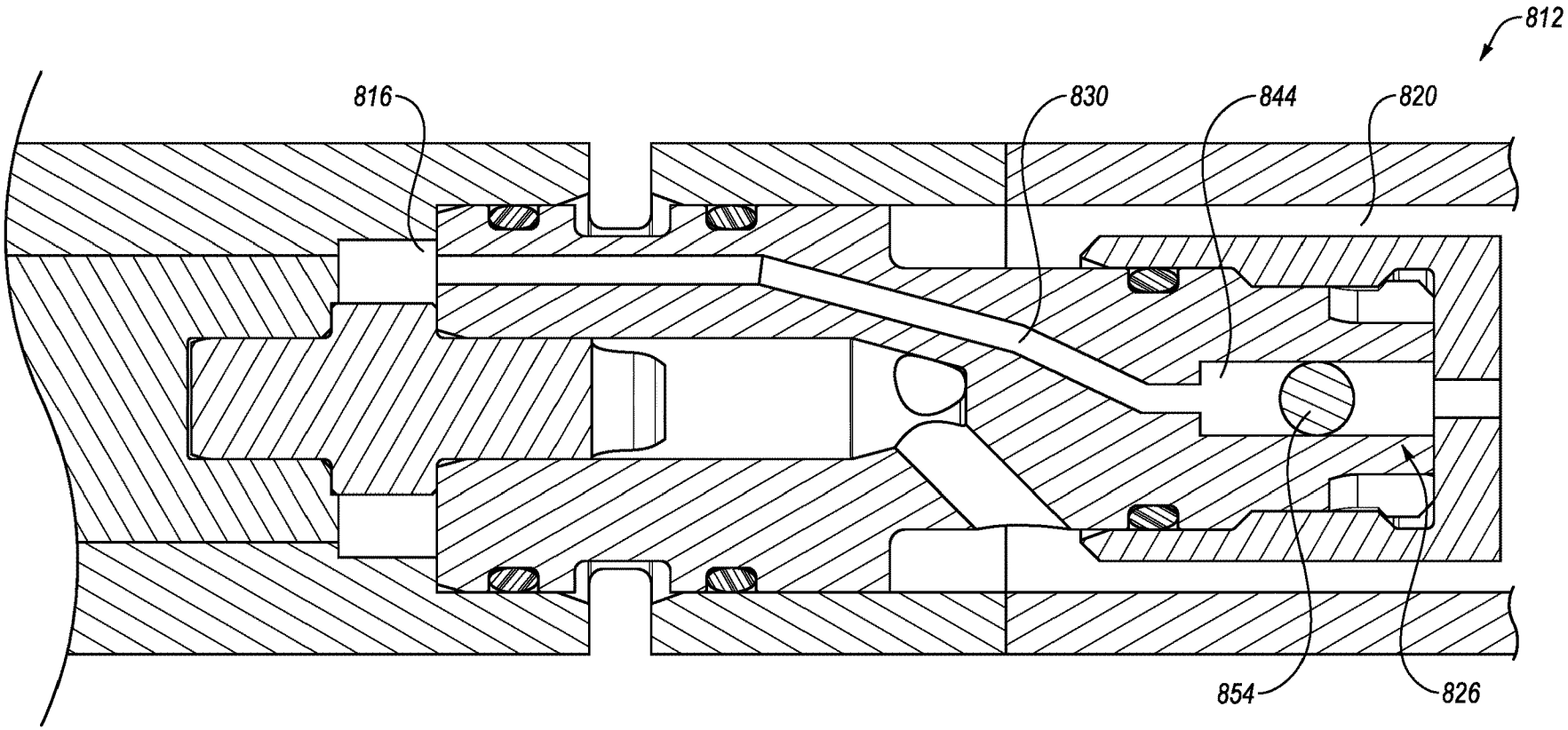
Figures 2, 8:
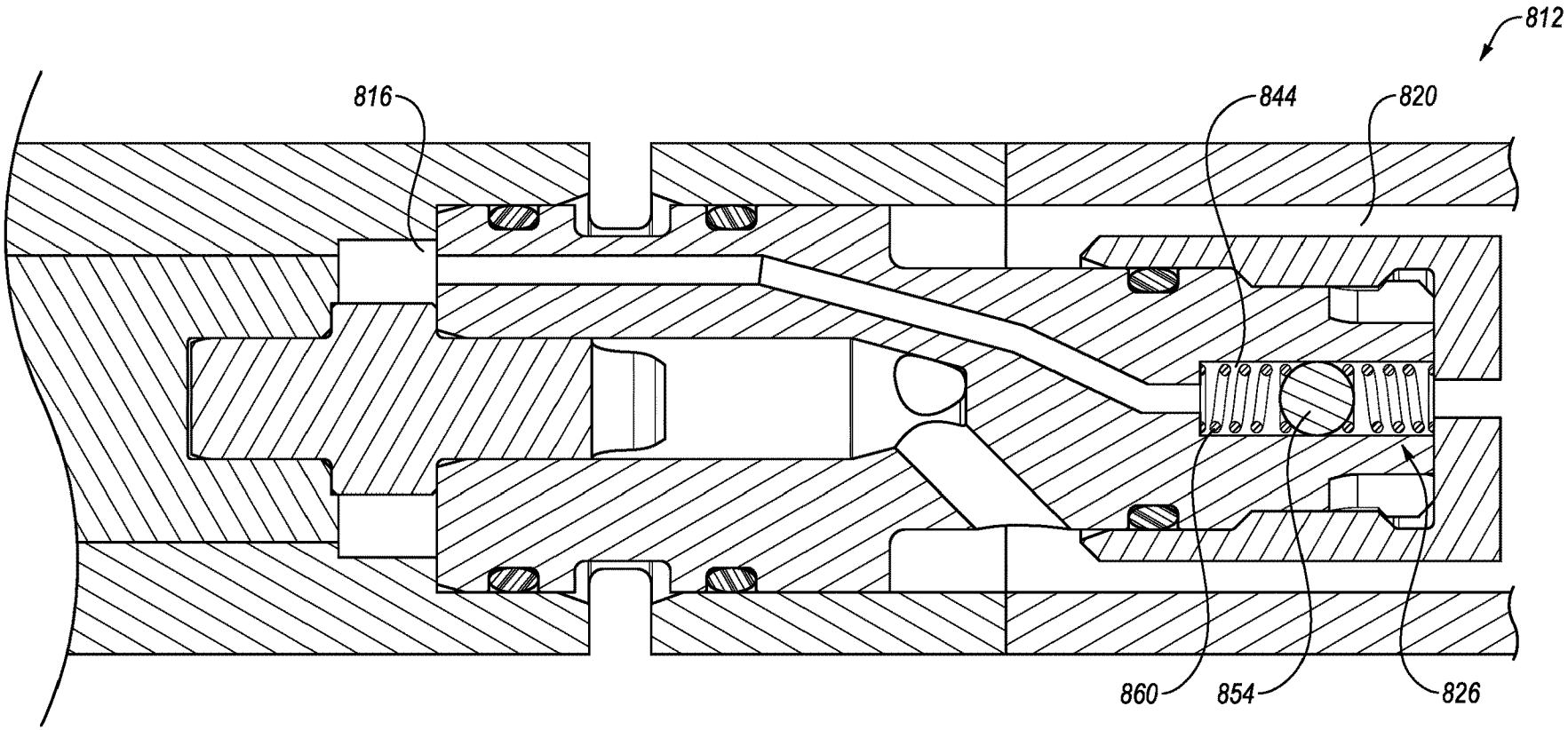

FIG. 8-1 is a representation of a downhole tool 812, according to at least one embodiment of the present disclosure. The downhole tool 812 may include at least some of the features and characteristics of the downhole tools described with respect to FIG. 2-1 through FIG. 7. The downhole tool 812 may include a flow path 830 connecting a housing chamber 816 to a fluid chamber 820. A pressure adjuster 826 may be located in an adjuster chamber 844 in the flow path 830. The pressure adjuster 826 may include a sealing member 854. The sealing member 854 may seal the flow path 830 from fluid flow between the fluid chamber 820 and the housing chamber 816.

As a pressure differential between the fluid chamber 820 and the housing chamber 816 increases, the pressure differential may act on the sealing member 854. The pressure differential may cause the sealing member 854 to move in the adjuster chamber 844. This may force fluid into or out of the housing chamber 816, which may adjust the pressure differential. The flow path 830 may be open to both the housing chamber 816 and the fluid chamber 820. Therefore, when the fluid chamber 820 has a higher pressure than the housing chamber 816, then the sealing member 854 may move toward the housing chamber 816, thereby increasing the pressure in the housing chamber 816. When the housing chamber 816 has a higher pressure than the fluid chamber 820, then the sealing member 854 may move toward the fluid chamber 820, thereby reducing the pressure in the housing chamber 816. In this manner, the pressure adjuster 826 may be a piston, or a compensation piston. Because the sealing member 854 may move toward both the housing chamber 816 and the fluid chamber 820, the pressure adjuster 826 may be bi-directional.

In some embodiments, the sealing member 854 may be a spherical ball. In other embodiments, the sealing member 854 may be cylindrical. In still other embodiments, the sealing member 854 may be any shape that may move in and seal the adjuster chamber 844. In some embodiments, the sealing member 854 may be a flexible diaphragm that stretches toward both the housing chamber 816 and the fluid chamber 820. In other embodiments, the sealing member 854 may be a bellows or other expandable and retractable member to seal the flow path 830.

FIG. 8-2 is a representation of a downhole tool 812, according to at least one embodiment of the present disclosure. The downhole tool 812 may include at least some of the features and characteristics of the downhole tools described with respect to FIG. 2-1 through FIG. 8-1. In at least one embodiment, the sealing member 854 of the pressure adjuster 826 may migrate toward either the housing chamber 816 or the fluid chamber 820. In other words, the sealing member 854 may move toward the housing chamber 816 or the fluid chamber 820 more than an increasing pressure differential may account for. This may happen due to vibration of the downhole tool 812, imperfections in the adjuster chamber 844, pulses in the pressure differential, or any other reason.

To maintain the sealing member 854 in a neutral position, opposing positioning springs 860 may push the sealing member 854 back to a neutral position. The opposing positioning springs 860 may push on the sealing member 854 with a force up to a relief pressure differential force. In some embodiments, the opposing positioning springs 860 may move the sealing member 854 into the neutral position using the same or other mechanisms that cause the sealing member to migrate in the first place, such as vibration, imperfections, pressure pulses, and so forth. Maintaining the sealing member 854 in a neutral position may extend the useful life of the pressure adjuster 826 past a single stroke of the sealing member 854 in either direction.

Figure 9:
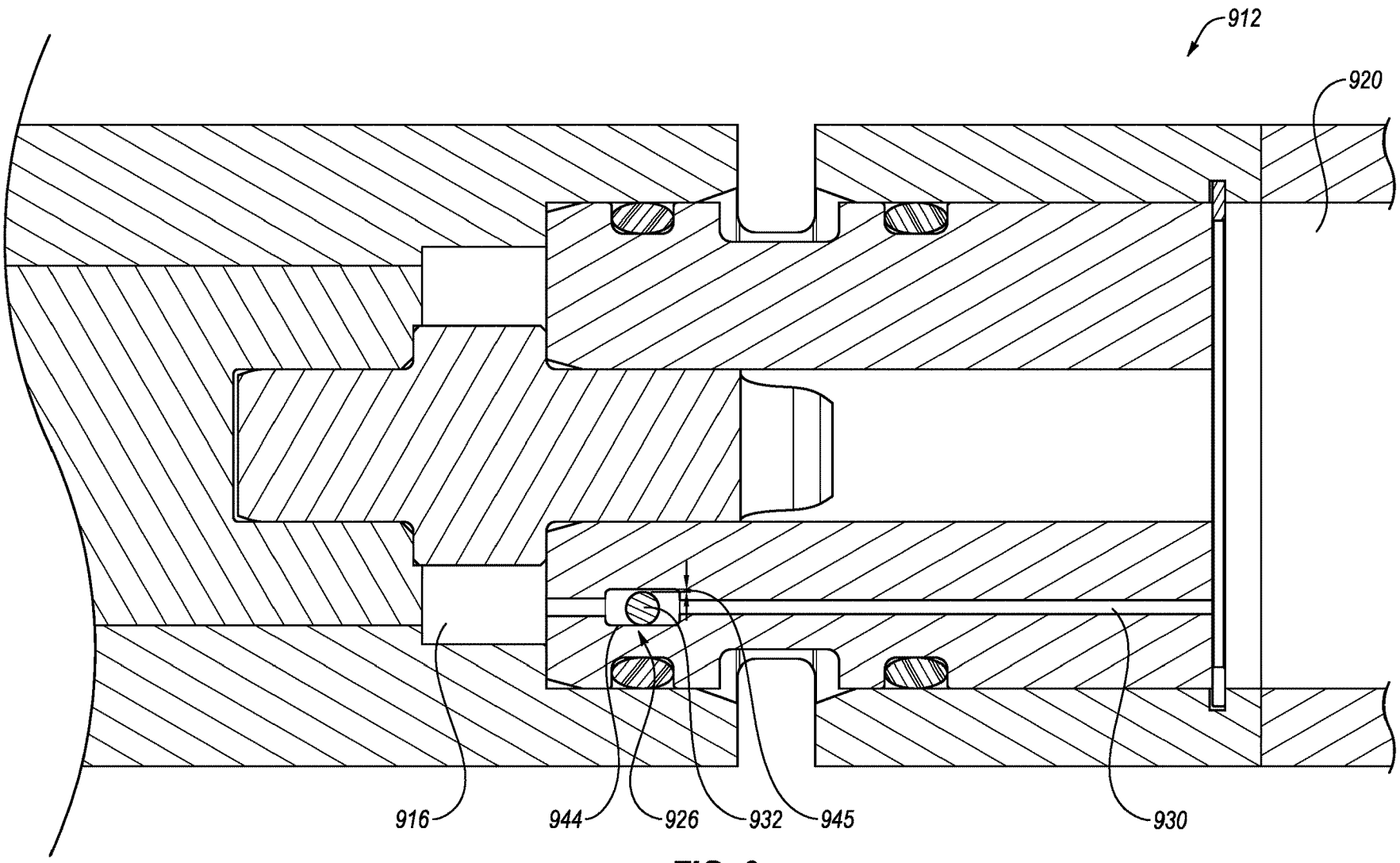
FIG. 9 is a cross-sectional view of a further pressure adjuster on a downhole tool, according to at least one embodiment of the present disclosure.

FIG. 9 is a representation of a downhole tool 912, according to at least one embodiment of the present disclosure. The downhole tool 912 may include at least some of the features and characteristics of the downhole tools described with respect to FIG. 2-1 through FIG. 8-2. The downhole tool 912 may include a flow path 930 connecting a housing chamber 916 to a fluid chamber 920. A pressure adjuster 926 may be located in the flow path 930. The pressure adjuster 926 may include one or more flow restrictors 932 in an adjuster chamber 944.

The flow restrictor 932 may have a flow restrictor cross-sectional area that is less than an adjuster chamber cross-sectional area. In this manner, fluid may flow through the flow path 930 while there is a pressure differential between the housing chamber 916 and the fluid chamber 920. At high pressure differentials, the fluid flow through the flow path 930 may be sufficient that sediment and other suspended particles do not settle in the adjuster chamber 944 and clog the flow path. Therefore, the flow restrictor 932 may help to equalize the pressure differential between the housing chamber 916 and the fluid chamber 920. At lower pressure differentials, sediment and other suspended particles may collect in the adjuster chamber 944, and may clog the flow path. Thus, when the downhole tool 912 reaches the operating depth, a lower pressure differential may be experienced, and the flow path 930 may clog. This may allow an operating pressure differential to be maintained without a fluid leak through the flow path 930 during operation.

The flow restrictor 932 may have a radial clearance 945 between the flow restrictor 932 and the adjuster chamber 944. In some embodiments, the radial clearance 945 may be in a range having an upper value, a lower value, or upper and lower values including any of 5 μm, 10 μm, 20 μm, 30 μm, 40 μm, 50 μm, 60 μm, 70 μm, 80 μm, 90 μm, 100 μm, 200 μm, 300 μm, 400 μm, 500 μm, or any value therebetween. For example, the radial clearance 945 may be greater than 5 μm. In another example, the radial clearance 945 may be less than 500 μm. In yet other examples, the radial clearance 945 may be any value in a range between 5 μm and 500 μm. In some embodiments, a radial clearance of 50 μm or less may be critical for the movable member 922 to reliably move upon actuation.

The flow restrictor 932 may have an area percentage that is a percentage of a flow restrictor cross-sectional area relative to the adjuster chamber cross-sectional area. In some embodiments, the area percentage may be in a range having an upper value, a lower value, or upper and lower values including any of 85%, 90%, 91%, 92%, 93%, 94%, 95%, 96%, 97%, 98%, 99%, or any value therebetween. For example, the area percentage may be greater than 85%. In another example, the area percentage may be less than 99%. In yet other examples, the area percentage may be any value in a range between 85% and 99%. In some embodiments, area percentages greater than 85% may be critical for the movable member 922 to reliably move upon actuation.

Figure 10:
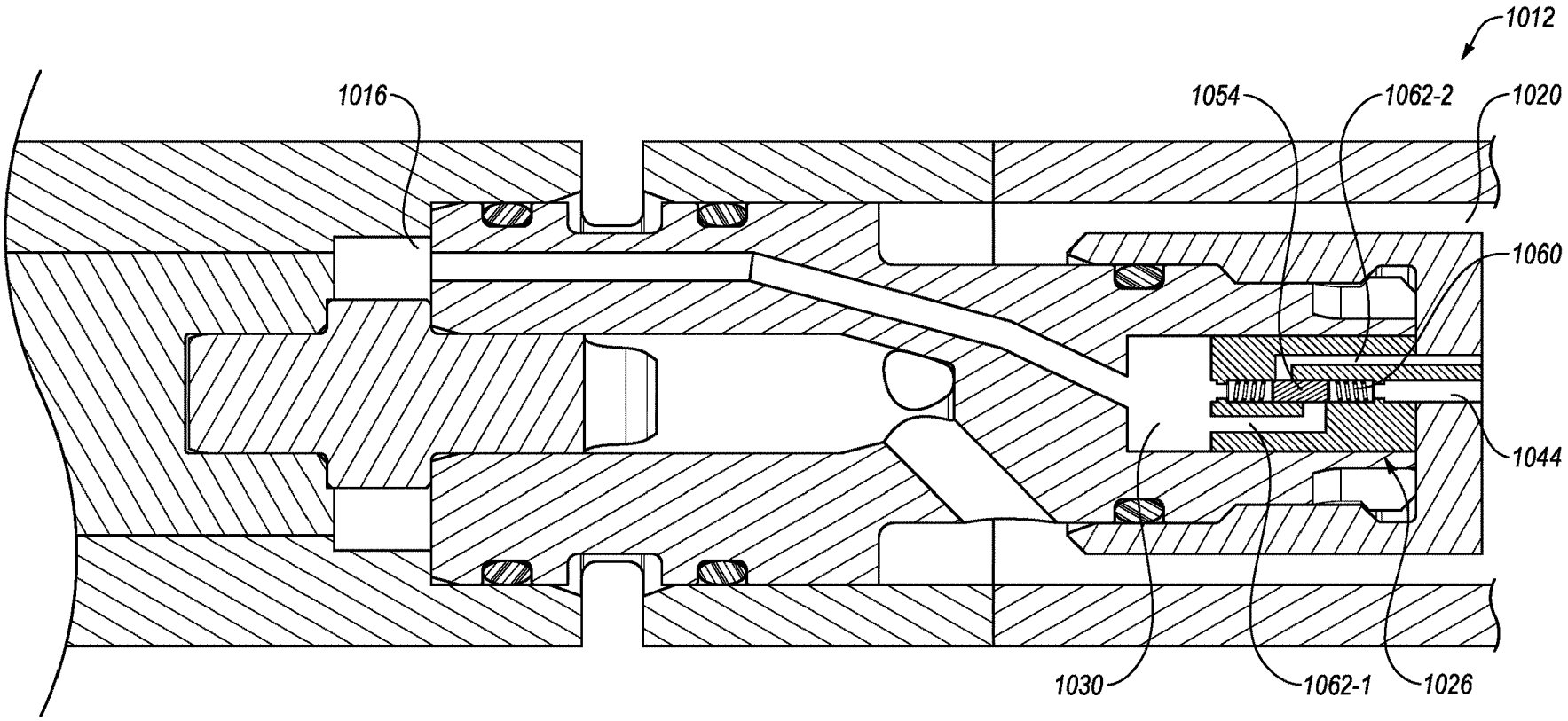
FIG. 10 is a cross-sectional view of a still further pressure adjuster on a downhole tool, according to at least one embodiment of the present disclosure.

FIG. 10 is a representation of an embodiment of a downhole tool 1012, according to at least one embodiment of the present disclosure. The downhole tool 1012 may include at least some of the features and characteristics of the downhole tools described with respect to FIG. 2-1 through FIG. 9. The downhole tool 1012 may include a flow path 1030 connecting a fluid chamber 1020 to a housing chamber 1016. A pressure adjuster 1026 may be located in the flow path 1030. The pressure adjuster 1026 may include a sealing member 1054 in an adjuster chamber 1044. The pressure adjuster 1026 may include a first alternate path 1062-1 and a second alternate path 1062-2. The sealing member 1054 may seal the adjuster chamber 1044 from fluid passing between the fluid chamber 1020 and the housing chamber 1016.

Opposing positioning springs 1060 may act on the sealing member 1054 to maintain the sealing member 1054 in a neutral position. In the neutral position, the sealing member 1054 may block the opening into the adjuster chamber of both the first alternate path 1062-1 and the second alternate path 1062-2. As the pressure differential between the fluid chamber 1020 and the housing chamber 1016 increases, the pressure differential may push against the sealing member 1054. At a relief pressure differential, the sealing member 1054 may expose one of the first alternate path 1062-1 or the second alternate path 1062-2 in the adjuster chamber 1044.

For example, when the pressure of the fluid chamber 1020 is greater than the pressure of the housing chamber 1016, then the sealing member 1054 may move toward the housing chamber 1016. When the pressure differential becomes greater than the relief pressure differential, then the first alternate path 1062-1 may be exposed. This may cause fluid to travel through the first alternate path 1062-1 and into the housing chamber 1016. When the pressure differential is reduced to below the relief pressure differential, the sealing member 1054 may be returned by the opposing position springs 1060 to the neutral position.

Similarly, when pressure of the housing chamber 1016 is greater than the pressure of the fluid chamber 1020, then the sealing member 1054 may move toward the fluid chamber 1020. When the pressure differential exceeds the relief pressure differential, then the second alternate path 1062-2 may be exposed. This may cause fluid to travel through the second alternate path 1062-2 to the fluid chamber. When the pressure differential is reduced below the relief pressure, the sealing member 1054 may be returned to the neutral position by the opposing positioning springs 1060. In this manner, the pressure adjuster 1026 may be bi-directional.

Figure 11:
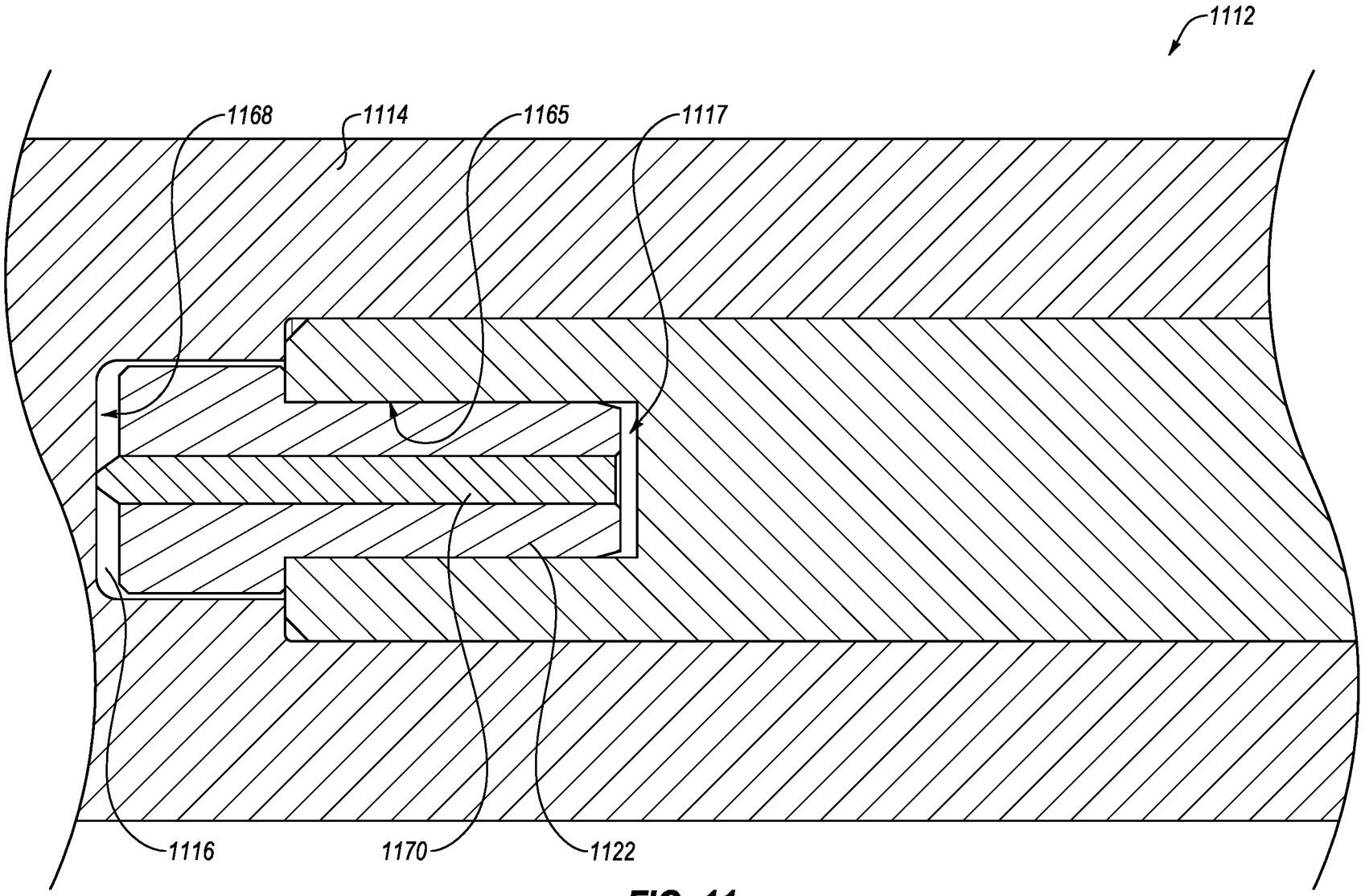
FIG. 11 is a cross-sectional view of a yet further pressure adjuster on a downhole tool, according to at least one embodiment of the present disclosure.

FIG. 11 is a representation of a downhole tool 1112, according to at least one embodiment of the present disclosure. The downhole tool 1112 may include at least some of the features and characteristics of the downhole tools described with respect to FIG. 2-1 through FIG. 10. The downhole tool 1112 may include a movable member 1122. A housing 1114 may include a bearing 1165 at a housing first end 1117. The movable member 1122 may rotate within the bearing with a close gap. In some embodiments, the gap may be between 10 and 100 μm, as described above with respect to FIG. 2-1. When a pressure differential is increased between a housing chamber 1116 in the housing 1114 and a fluid chamber (not shown), solids may collect at the bearing, and the torque required to rotate the movable member may be increased.

The housing chamber 1116 may include a bearing surface 1168 at a housing second end 1166. The movable member 1122 may include a central support 1170. The movable member 1122 may be supported by the central support 1170 at the bearing surface 1168. Because the movable member 1122 is supported by the central support 1170, the only friction to be overcome by a torque during operation is the friction of the central support 1170 against the bearing surface 1168. By reducing the bearing area of the central support 1170, the torque required to rotate the movable member 1122 may be reduced.

The central support 1170 engages the bearing surface 1168 with a bearing radius. In some embodiments, the central support 1170 may have a sharp point that engages the bearing surface 1168. Thus, the bearing radius may be small, which may reduce the torque required to rotate the movable member 1122. In some embodiments, the bearing radius may be in a range having an upper value, a lower value, or upper and lower values including any of 1 μm, 10 μm, 25 μm, 50 μm, 75 μm 100 μm, 250 μm, 500 μm, 750 μm, 1.0 millimeter (mm), 2.5 mm, 5.0 mm, 7.5 mm, 10 mm, 25 mm, 50 mm, or any value therebetween. For example, the bearing radius may be greater than 1 μm. In another example, the bearing radius may be less than 50 mm. In yet other examples, the bearing radius may be any value in a range between 1 μm and 50 mm. In some embodiments, a radial clearance of 1 mm or less may be critical for the movable member 1122 to reliably move upon actuation. In another embodiment, a radial clearance of 5 mm or less may be critical for the movable member 1122 to reliably move upon actuation. In yet other embodiments, a radial clearance of between 1 and 5 mm may permit the movable member 1122 to reliably move upon actuation.

The bearing area of the central support 1170 may be a support percentage, or the percentage of the bearing area with respect to a movable member cross-sectional area. In some embodiments, the support percentage may be in a range having an upper value, a lower value, or upper and lower values including any of 25%, 20%, 15%, 10%, 9%, 8%, 7%, 6%, 5%, 4%, 3%, 2%, 1%, or any value therebetween. For example, the support percentage may be greater than 1%. In another example, the support percentage may be less than 25%. In yet other examples, the support percentage may be any value in a range between 1% and 25%. In some embodiments, support percentages below 10% may be critical for the movable member 1122 to be rotated at high differential pressures.

Due to the high rotational rates to which the movable member 1122 may be subjected, both the central support 1170 and the bearing surface 1168 may be made from an ultrahard material. For example, one or both of the central support 1170 and the bearing surface 1168 may be made from PCD, tungsten carbide (WC), cubic boron nitride, or any other ultrahard material. In other embodiments, general to hard materials such as ceramics or metals may be used. In some embodiments, the downhole tool 1112 may include a combination of a central support 1170 rotating on a bearing surface 1168 and one or more of the pressure adjusters discussed with respect to FIG. 2-1 through FIG. 10. In some embodiments, the central support 1170 and the bearing surface 1168 may rotate on a bearing, such as a ball bearing. For example, the central support 1170 may include a ball at the contact point between the central support 1170 and the bearing surface 1168. The ball may contact the bearing surface 1168 and rotate with respect to both the bearing surface 1168 and the central support 1170. A ball bearing may rotate in response to a lower torque on the movable member 1122.

Figure 12:
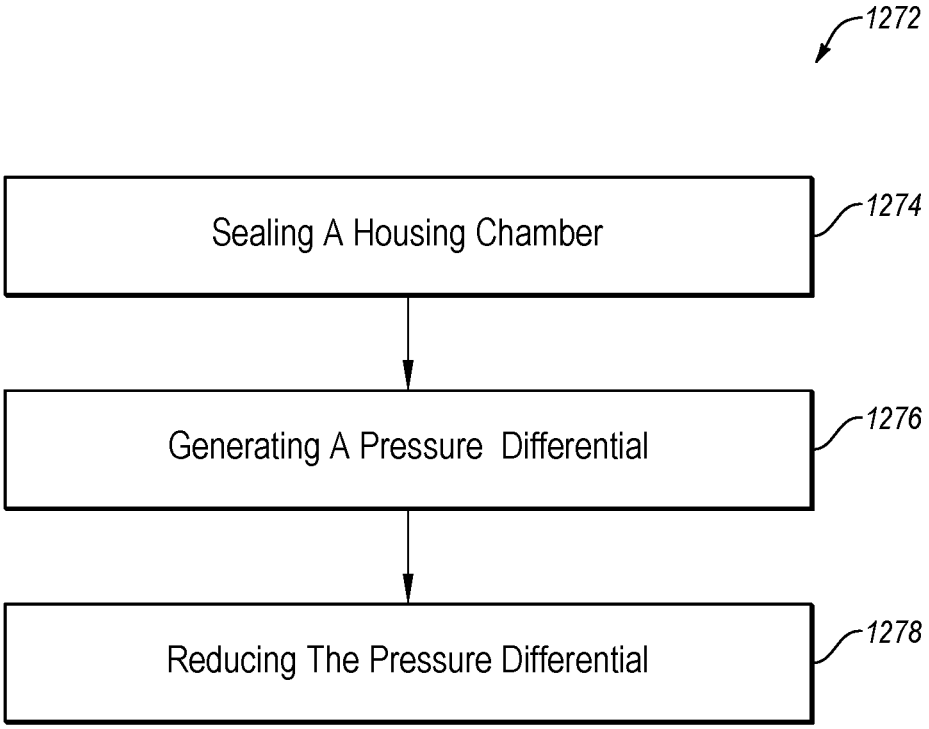
FIG. 12 is a method chart of a method for operating a downhole tool, according to at least one embodiment of the present disclosure.

FIG. 12 is a method chart of a method 1272 for operating a downhole tool, according to at least one embodiment of the present disclosure. The method 1272 may include sealing a housing chamber in a housing at 1274. A movable member may be inserted in and rotatable relative to the housing chamber. The movable member may rotate against a bearing with a tight gap, the gap creating the seal. The method 1272 may further include generating a pressure differential across the seal between a fluid chamber and the housing chamber at 1276. The pressure differential may be generated as a result of an increasing hydrostatic pressure in the fluid chamber or an increased pressure in the housing chamber. Generating the pressure differential may include clogging the seal with particles suspended in the fluid.

The method 1272 may further include reducing the pressure differential with a pressure adjuster at 1278. Reducing the pressure differential may include overcoming a relief pressure differential in the pressure adjuster. Reducing the pressure differential may further include moving a sealing member or a flow restrictor along an adjuster chamber in response to the pressure differential.

The embodiments of the pressure adjuster have been primarily described with reference to wellbore drilling operations; the pressure adjusters described herein may be used in applications other than the drilling of a wellbore. In other embodiments, pressure adjusters according to the present disclosure may be used outside a wellbore or other downhole environment used for the exploration or production of natural resources. For instance, pressure adjusters of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

The articles "a," "an," and "the" are intended to mean that there are one or more of the features in the preceding descriptions. Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A downhole tool, comprising:

a housing;

a housing chamber disposed within the housing;

a fluid chamber disposed within the housing;

a partition disposed within the housing, the partition separating the housing chamber from the fluid chamber;

a movable member disposed within the housing, the moveable member configured to move relative to the housing through the partition, and the moveable member further configured to restrict flow between the housing chamber and the fluid chamber to maintain a pressure differential between the housing chamber and the fluid chamber; and at least one pressure adjuster separate and distinct from the moveable member, the at least one pressure adjuster operably disposed between the housing chamber and the fluid chamber, and the at least one pressure adjuster configured to maintain the pressure differential between the housing chamber and the fluid chamber below a maximum pressure differential set by the pressure adjuster.

2. The downhole tool of claim 1, wherein the movable member is configured to rotate relative to the partition.

3. The downhole tool of claim 1, wherein the movable member is a turbine in a power generator.

4. The downhole tool of claim 1, wherein the movable member is a rotor of a rotary valve.

5. The downhole tool of claim 1, wherein the at least one pressure adjuster includes:

an adjuster chamber in fluid communication with the housing chamber and the fluid chamber;

a seat at a high pressure side of the adjuster chamber; and a flow restrictor in the adjuster chamber.

6. The downhole tool of claim 5, wherein the at least one pressure adjuster further includes a resilient member urging the flow restrictor against the seat with a force sufficient to maintain the maximum pressure differential.

7. The downhole tool of claim 6, wherein the flow restrictor is configured to move in the adjuster chamber in response to the pressure differential between the housing chamber and the fluid chamber.

8. The downhole tool of claim 5, wherein the at least one pressure adjuster further includes opposing positioning springs maintaining the flow restrictor in a neutral position.

9. The downhole tool of claim 1, wherein the at least one pressure adjuster includes:

an adjuster chamber in fluid communication with the housing chamber and the fluid chamber;

a seat at a high pressure side of the adjuster chamber;

a sealing member in the adjuster chamber; and opposing positioning springs maintaining the sealing member in a neutral position, the sealing member blocking an opening to a first alternate path and a second alternate path in the neutral position.

10. The downhole tool of claim 1, wherein the at least one pressure adjuster includes a first pressure adjuster and a second pressure adjuster, the first pressure adjuster adjusting pressure from the fluid chamber to the housing, the second pressure adjuster adjusting pressure from the housing to the fluid chamber.

11. The downhole tool of claim 1, wherein the at least one pressure adjuster includes a diaphragm, the diaphragm opening an aperture between the housing and the fluid chamber in response to the pressure differential between the housing chamber and the fluid chamber.

12. The downhole tool of claim 1, wherein the partition and the movable member are spaced from one another by a gap of 500 μm or less.

13. The downhole tool of claim 1, wherein the partition includes a bearing disposed between the movable member and the housing.

14. The downhole tool of claim 1, wherein at least part of the at least one pressure adjuster is disposed within the partition.

15. The downhole tool of claim 1, wherein the at least one pressure adjuster includes an adjuster chamber, and a flow restrictor in the adjuster chamber including a radial clearance of less than 500 μm.

16. The downhole tool of claim 1, wherein:

the housing has a first end and a second end;

the movable member is connected to the housing at the first end with a bearing, the bearing having a gap of less than 500 μm between the bearing and the movable member, the moveable member being rotatable relative to the housing, the movable member including a central support; and a bearing surface is disposed inside the housing at the second end, the bearing surface supporting the central support.

17. The downhole tool of claim 16, wherein the central support is configured to engage the bearing surface with a bearing radius of 1 mm or less.

18. The downhole tool of claim 1, wherein the moveable member is disposed in a first flow path between the housing chamber and the fluid chamber, and the at least one pressure adjuster is disposed in at least one second flow path between the housing chamber and the fluid chamber, the at least one second flow path being separate and distinct from the first flow path.

* * * * *